US012709447B2

(12) United States Patent
Chambers

(10) Patent No.: US 12,709,447 B2
(45) Date of Patent: Aug. 18, 2026

(54) SYSTEMS AND METHODS FOR LOCKING PACKAGING CONTAINER

(71) Applicant: All Packaging Company LLC, Aurora, CO (US)

(72) Inventor: Christopher Chambers, Aurora, CO (US)

(73) Assignee: All Packaging Company LLC, Aurora, CO (US)

( * ) Notice: Subject to any disclaimer, the term of this patent is extended or adjusted under 35 U.S.C. 154(b) by 0 days.

(21) Appl. No.: 18/299,681

(22) Filed: Apr. 12, 2023

(65) Prior Publication Data

US 2023/0242308 A1 Aug. 3, 2023

Related U.S. Application Data

(63) Continuation-in-part of application No. 17/071,884, filed on Oct. 15, 2020, now Pat. No. 11,628,990.

(Continued)

(51) Int. Cl.
*B65D 50/06* (2006.01)
*B65D 5/38* (2006.01)

(52) U.S. Cl.
CPC ..... *B65D 50/066* (2013.01); *B65D 5/38* (2013.01); *B65D 2215/04* (2013.01); *B65D 2255/20* (2013.01)

(58) Field of Classification Search
CPC ..... B31B 50/22; B31B 50/26; B31B 50/48; B31B 50/62; B31B 50/624;

(Continued)

(56) References Cited

U.S. PATENT DOCUMENTS 3,761,010 A * 9/1973 Rosenburg, Jr. ..... B65D 5/38 206/804
6,491,211 B1 * 12/2002 Evans ..... B65D 77/02 206/532

(Continued)

FOREIGN PATENT DOCUMENTS

CN 109878854 A 6/2019
DE 4228026 A1 * 3/1994 ..... B42F 17/18

(Continued)

OTHER PUBLICATIONS

International Search Report and Written Opinion received for PCT Patent Application No. PCT/US2020/055842, mailed on Jan. 19, 2021, 11 pages.

(Continued)

*Primary Examiner* — Shelley M Self
*Assistant Examiner* — Linda J. Hodge
(74) *Attorney, Agent, or Firm* — Holland & Hart LLP

(57) ABSTRACT

The technology disclosed herein includes a method of manufacturing a packaging apparatus including an outer sleeve and an inner sleeve. The method includes assembling the outer sleeve including a first glue lap and a bottom panel. Assembling the outer sleeve includes applying at least two glue lines on the first glue lap. Assembling the outer sleeve also includes folding the first glue lap onto the bottom panel such that the at least two glue lines adhere the first glue lap to the bottom panel. The method also includes assembling the inner sleeve using a second folder/gluer. The inner sleeve comprises a locking tab configured to interface the locking ridge of the outer sleeve to secure the inner sleeve within the outer sleeve. The method further includes assembling the packaging apparatus by inserting the inner sleeve into the outer sleeve.

14 Claims, 27 Drawing Sheets

Related U.S. Application Data

(60) Provisional application No. 62/915,602, filed on Oct. 15, 2019.

(58) Field of Classification Search
CPC . B31B 2120/402; B31B 2120/60; B31F 5/04; B65B 43/41; B65D 5/38; B65D 2215/04; B65D 50/066; B54D 2255/20
USPC ..... 493/102; 53/169; 206/1.5; 229/125.125, 229/122, 913
See application file for complete search history.

(56) References Cited

U.S. PATENT DOCUMENTS

| | | | | |
|---|---|---|---|---|
| 7,658,287 | B2 | 2/2010 | Hession | |
| 7,708,142 | B2 | 5/2010 | Ehrlund | |
| 7,757,843 | B2 | 7/2010 | Katsis | |
| 7,832,624 | B2 * | 11/2010 | Kong | B65D 5/38 229/913 |
| 8,939,281 | B2 | 1/2015 | Matsuba et al. | |
| 9,475,605 | B2 | 10/2016 | Everett | |
| 9,783,335 | B2 | 10/2017 | Everett | |
| 10,518,927 | B2 | 12/2019 | Chambers | |
| 11,053,045 | B2 | 7/2021 | Chambers | |
| 11,059,645 | B2 | 7/2021 | Chambers et al. | |
| 11,319,108 | B2 * | 5/2022 | Gauvin | B65D 5/38 |
| 11,345,507 | B2 | 5/2022 | Palmer et al. | |
| 11,643,244 | B2 * | 5/2023 | Valencia | B31B 50/26 206/557 |
| 12,012,259 | B2 | 6/2024 | Green et al. | |
| 2007/0251983 | A1 | 11/2007 | Freeze | |
| 2012/0012497 | A1 * | 1/2012 | Weston | B65D 77/0413 206/531 |
| 2012/0234701 | A1 | 9/2012 | Albrecht et al. | |
| 2013/0140201 | A1 | 6/2013 | Ghini et al. | |
| 2015/0307246 | A1 | 10/2015 | Patwardhan | |
| 2016/0001937 | A1 * | 1/2016 | Skinner | B65D 5/38 206/1.5 |
| 2016/0152373 | A1 | 6/2016 | Linssen | |
| 2016/0251107 | A1 | 9/2016 | Everett | |
| 2017/0036808 | A1 | 2/2017 | Everett | |
| 2017/0297803 | A1 | 10/2017 | Chambers et al. | |
| 2018/0072452 | A1 | 3/2018 | Chambers | |
| 2018/0105314 | A1 | 4/2018 | Jones | |
| 2019/0084740 | A1 | 3/2019 | Davis et al. | |
| 2019/0233158 | A1 | 8/2019 | Jones | |
| 2019/0375537 | A1 * | 12/2019 | Nakovski | B65B 5/04 |
| 2020/0180808 | A1 | 6/2020 | Gauvin | |
| 2021/0016939 | A1 | 1/2021 | Palmer et al. | |
| 2022/0119171 | A1 | 4/2022 | Levitz | |

FOREIGN PATENT DOCUMENTS

| | | | | |
|---|---|---|---|---|
| JP | 3216684 | B2 * | 10/2001 | B22D 23/00 |
| JP | 3216684 | U | 6/2018 | |
| WO | 2012/112538 | A1 | 8/2012 | |
| WO | 2018/190910 | A1 | 10/2018 | |
| WO | 2020/033044 | A1 | 2/2020 | |
| WO | WO-2021070133 | A1 * | 4/2021 | B65D 5/38 |

OTHER PUBLICATIONS

European Patent Office, "Extended Search Report," issued in connection with European Patent Application No. 20876629.5 dated Oct. 11, 2023 (10 pages).

* cited by examiner

SYSTEMS AND METHODS FOR LOCKING PACKAGING CONTAINER

CROSS REFERENCE TO RELATED APPLICATIONS

This application is a continuation-in-part of U.S. patent application Ser. No. 17/071,884, filed 15 Oct. 2020, which claims the benefit of U.S. Provisional Patent Application No. 62/915,602, filed 15 Oct. 2019, the disclosures of which are incorporated herein, in their entireties, by this reference.

BACKGROUND

Cartons or other paperboard containers may be used for holding and storing items. In some implementations, the items held or stored in the containers may be harmful to certain users, such as children (e.g., a pharmaceutical drug, tobacco, etc.). A user may desire to hold or store items in a lockable, child-resistant container. At least some known methods for manufacturing cartons or other paperboard containers merely include inserting the items into the container, applying glue to at least one flap of the container, and folding the flap such that the glue adheres the flap to another portion of the container to form and hold the container in a predetermined container shape. However, merely gluing the flaps of the containers may manufacture a container that is easily accessed by tearing the flaps of the contain and certain users, such as children, may be able to access the items in the container.

SUMMARY

The technology disclosed herein includes an environmentally friendly, re-lockable packaging apparatus comprising an outer sleeve, an inner sleeve, and at least one locking mechanism configured to lock the inner sleeve inside the outer sleeve, wherein a locking tab of the inner sleeve connected to a bottom panel of the inner sleeve is configured to move from a position in between and substantially parallel to the bottom panel of the inner sleeve and a middle panel of the outer sleeve to an angled position protruding into a first area of the outer sleeve proximate to a bottom panel of the outer sleeve and adjacent to the middle panel of the outer sleeve, and engage a locking ridge located on an end of the middle panel of the outer sleeve. The edge of the locking ridge and edge of the locking tab of the inner sleeve may be arc-shaped and the edge of the locking ridge and edge of the locking tab of the inner sleeve may be configured to oppose one another to form the first locking mechanism.

In some implementations, technology disclosed herein includes a method of manufacturing a packaging apparatus including an outer sleeve and an inner sleeve. The method includes assembling the outer sleeve using a first folder/gluer. The outer sleeve comprises a first glue lap and a bottom panel. Assembling the outer sleeve includes applying at least two glue lines on the first glue lap. Assembling the outer sleeve also includes folding the first glue lap onto the bottom panel such that the at least two glue lines adhere the first glue lap to the bottom panel. The first glue lap and the bottom panel form a locking ridge. The method also includes assembling the inner sleeve using a second folder/gluer. The inner sleeve comprises a locking tab configured to interface the locking ridge of the outer sleeve to secure the inner sleeve within the outer sleeve. The locking ridge and the locking tab at least partially define a locking mechanism.

The method further includes assembling the packaging apparatus by inserting the inner sleeve into the outer sleeve.

In some implementations, technology disclosed herein includes a method of manufacturing a packaging apparatus including an outer sleeve. The method includes assembling the outer sleeve using a first folder/gluer. The outer sleeve comprises a first glue lap and a bottom panel. Assembling the outer sleeve includes applying at least two glue lines on the first glue lap and folding the first glue lap onto the bottom panel such that the at least two glue lines adhere the first glue lap to the bottom panel. The first glue lap and the bottom panel form a locking ridge of a locking mechanism.

These and various other features and advantages will be apparent from a reading of the following Detailed Description.

DETAILED DESCRIPTION

Figure 1:
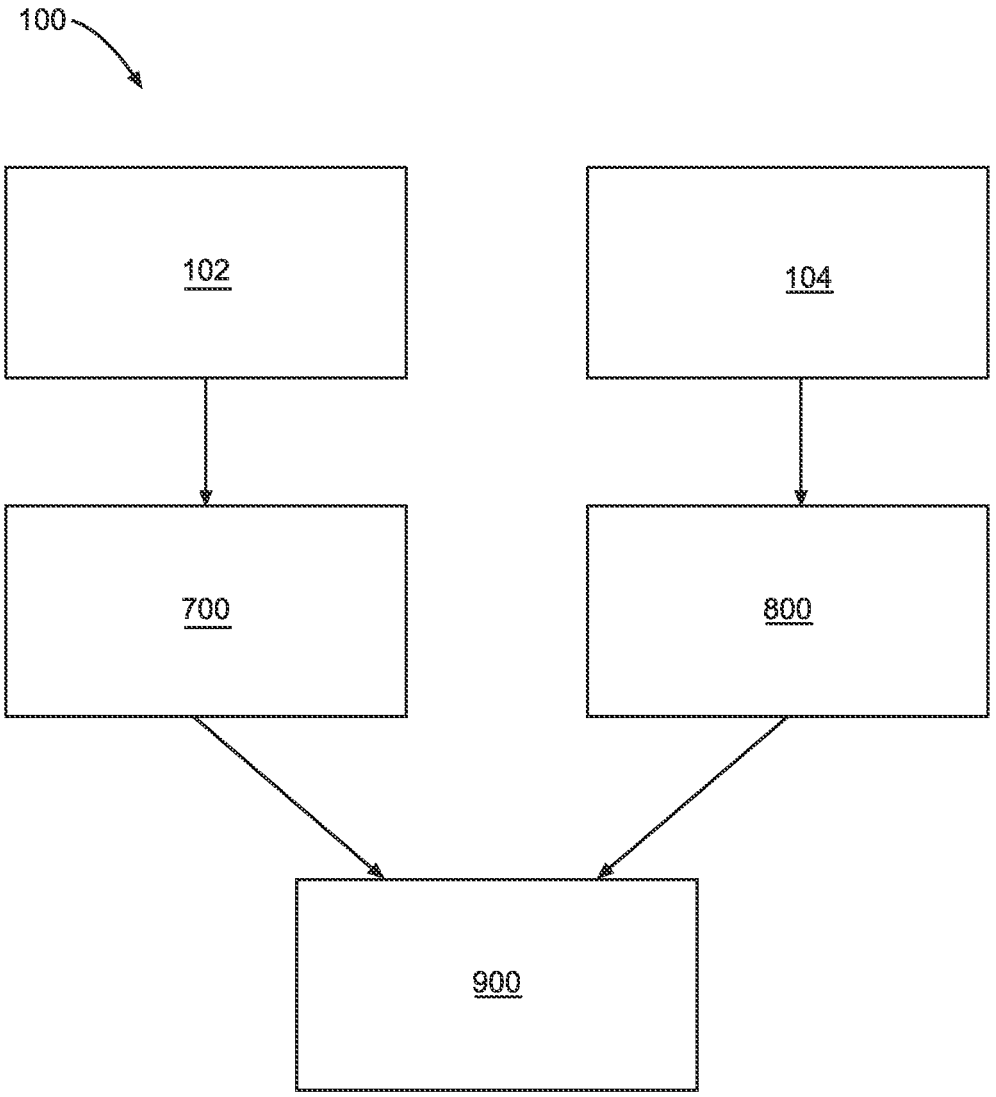
FIG. 1 illustrates a flowchart of an example method of manufacturing a packaging apparatus.

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular implementations, it should be appreciated that the features described with respect to one implementation may be incorporated with some implementations as well. Similarly, however, no single feature or features of any described implementation should be considered essential to the invention, as some implementations of the invention may omit such features.

For purposes of this disclosure, the term "substantially parallel" refers to a position wherein a tab lies sufficiently flat in relation to a first surface in an effort to slide between the first surface and a second surface opposing the first surface. For example, in some implementations, "substantially parallel" may be 0°-5° from the first surface.

For purposes of this disclosure, the term "locking" refers to a position wherein a tab is caught or latched onto another surface in an effort to prevent movement and create a locking mechanism as the tab is trapped in the latched position. For example, in some implementations, "locking" may mean a tab, for example, is prevented from movement because the tab is fighting against another surface when it is being pulled against the surface.

The disclosed technology includes packaging apparatuses configured to lock internally. In some implementations, the packaging apparatus may have a storage compartment, or an insert containing a compartment to hold, store, and secure an item. The packaging apparatus are child-resistant, easy to manufacture, and easy to use. In some implementations, the packaging apparatus are environmentally friendly and made of paperboard and have folding capabilities to reduce packaging. In some implementations, the packaging apparatus may be tamper-evident and/or senior-friendly. The packaging apparatus include panels, tabs, flaps, and apertures that may have various shapes (e.g., oval, rectangular, circular, etc.) depending on the intended use and manufacturing requirements (e.g., auto-erecting walls requirements). The panels, tabs, flaps, apertures, and other components of the packaging apparatus may have different locations in the packaging apparatus than what is shown in the figures. For example, a panel or tab may be moved in a packaging apparatus to accommodate better functioning of one of the disclosed locking mechanisms.

In some implementations, the panels, tabs, flaps, apertures, and other components of the packaging apparatus may have memory properties. Specifically, a locking tab may be able return to an original pre-bended shape or position after the locking tab is pressed in a certain direction. For example, if a paperboard locking tab has memory properties and is attached and extending from an end of a panel, and the paperboard locking tab is moved (or bended) around the end of the panel to be positioned substantially parallel on the panel and released, the locking tab will attempt to return or return to its original pre-bent shape or position.

FIGS. 1 and 7-9 illustrate flow diagrams of an example method 100 of manufacturing a packaging apparatus 200 (shown in FIGS. 2-6). In the illustrated embodiment, the method 100 described herein manufactures the packaging apparatus 200 that is child resistant such that a child will not be able to access the contents of the packaging apparatus 200. More specifically, the packaging apparatus 200 has an outer sleeve 202, an inner sleeve 204, and a locking mechanism. The locking mechanism is formed by applying additional glue in predetermined locations and adding additional folds to increase the strength of the packaging apparatus 200 and forms the locking mechanism that is child resistant. If a child, for example, tries to get into the packaging apparatus 200 and forcefully grabs or pulls the packaging apparatus 200, the locking mechanism is configured to prevent the child from accessing the packaging apparatus 200 and the additional glue and folds resist tearing. Accordingly, the methods described herein enable the packaging apparatus 200 to be child resistant such that a child will not be able to access the contents of the packaging apparatus 200.

Figure 8:
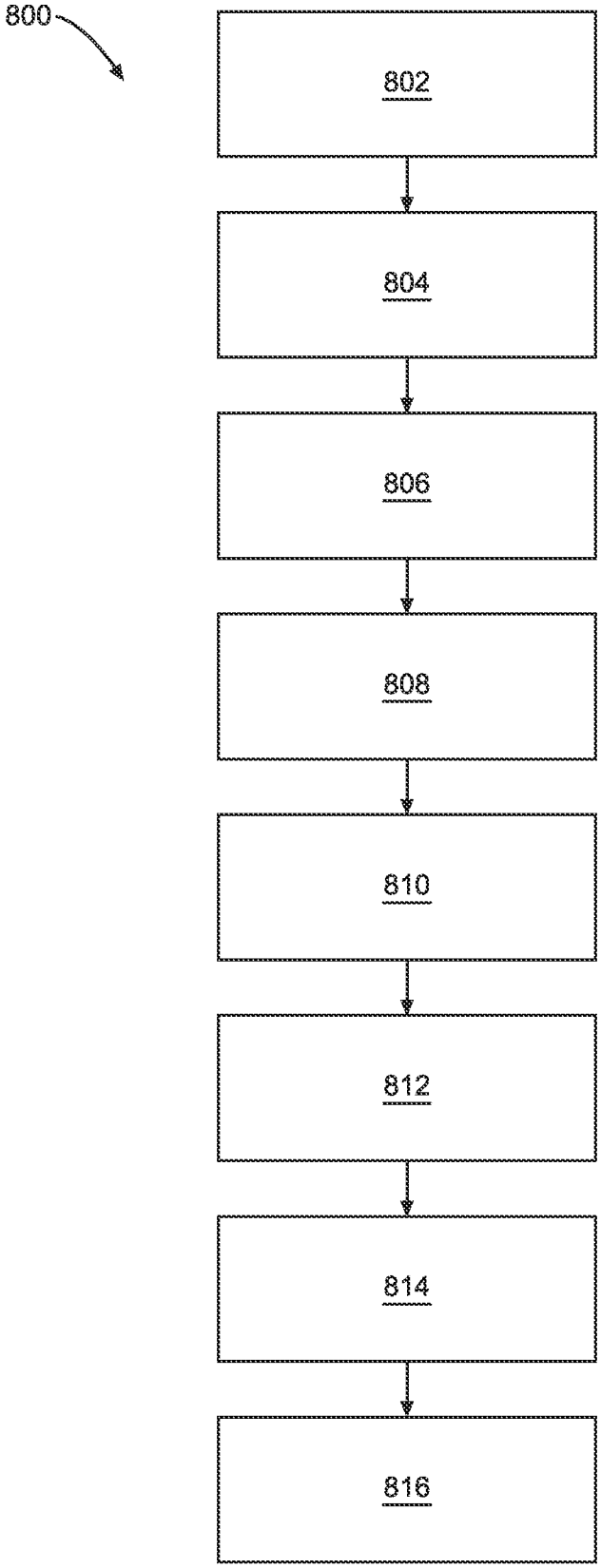
FIG. 8 illustrates a flowchart of an example method of manufacturing a packaging apparatus.
Figure 9:
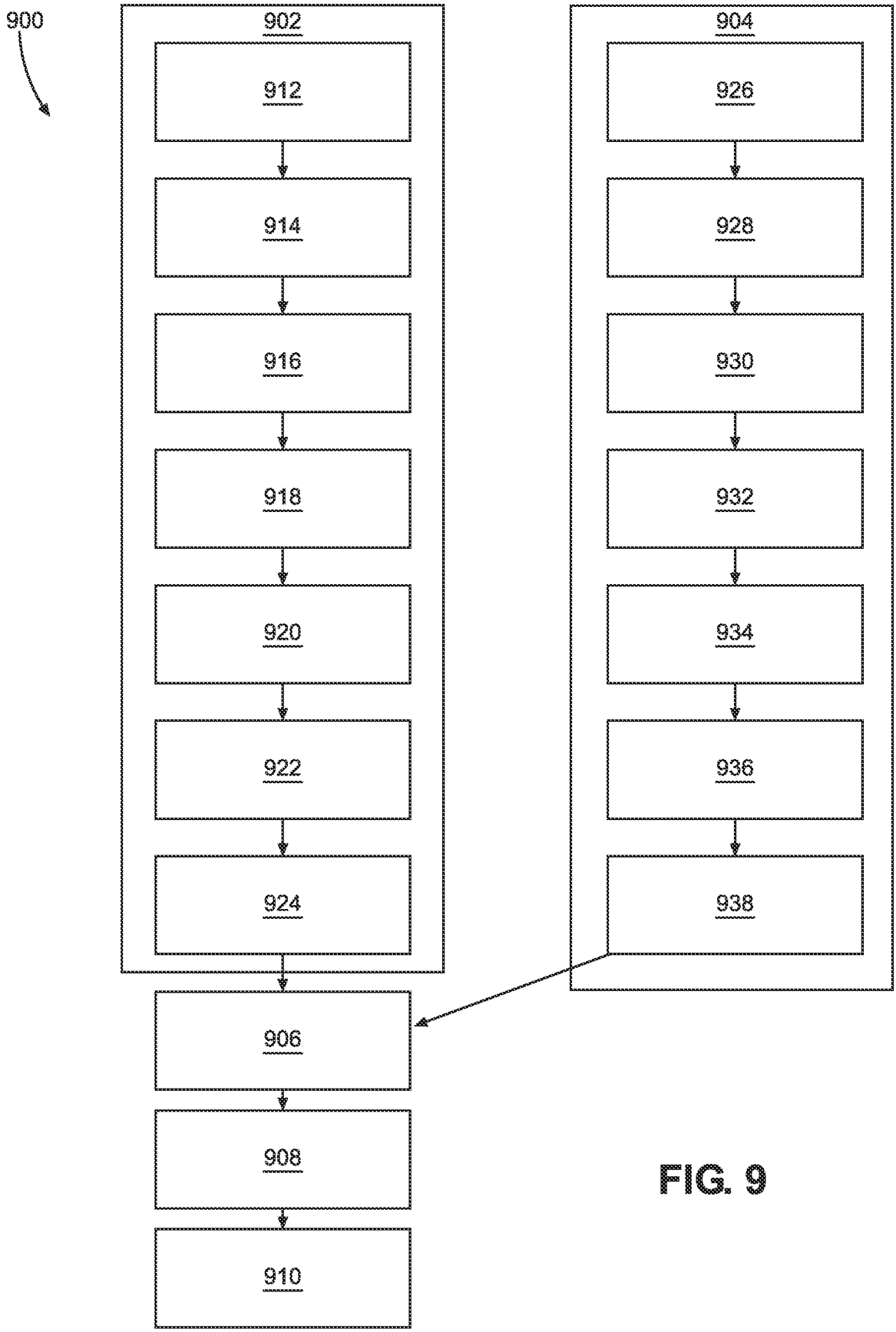
FIG. 9 illustrates a flowchart of an example method of manufacturing a packaging apparatus.

Method 100 includes assembling 700 the outer sleeve 202 (shown in FIG. 7), assembling 800 the inner sleeve 204 (shown in FIG. 8), and assembling and packing 900 the packaging apparatus 200 (shown in FIG. 9). The method 100 also includes producing and receiving 102 precut cartons of the outer sleeve 202 and producing and receiving 104 precut cartons of the inner sleeve 204. Producing and receiving 102 precut cartons of the outer sleeve 202 includes precutting the cartons of the outer sleeve 202 and/or preprinting designs on at least one side of the cartons of the outer sleeve 202.

Figure 2A:
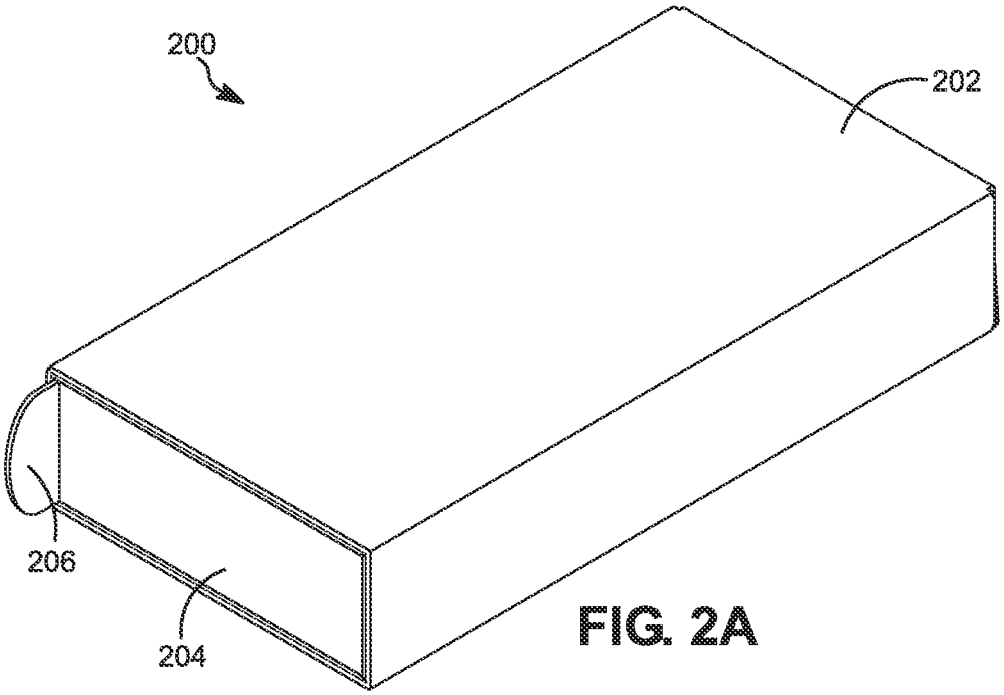
FIG. 2A illustrates a perspective top view of an example packaging apparatus in a closed position.

FIG. 2A illustrates a perspective top view of an example packaging apparatus 200 manufactured using method 100. The packaging apparatus 200 has an outer sleeve 202 manufactured using methods 700 and 900, an inner sleeve 204 manufactured using methods 700 and 900, and a pull tab 206. The pull tab 206 may be pulled by a user to pull the inner sleeve 204 from the outer sleeve 202 when the packaging apparatus 200 is in a closed position to open the packaging apparatus 200. In some implementations, the pull tab 206 may be configured to have a 'tear away' function. Specifically, there may be a cut located on both sides of the pull tab 206. If a child, for example, tries to get into the packaging apparatus 200 and forcefully grabs or pulls the pull tab 206, the tab 206 is configured to rip off or tear away. As a result, the packaging apparatus 200 is then tamper-evident, and the child will not be able to pull the inner sleeve 204 from the outer sleeve 202 via the pull tab 206.

Figure 2B:
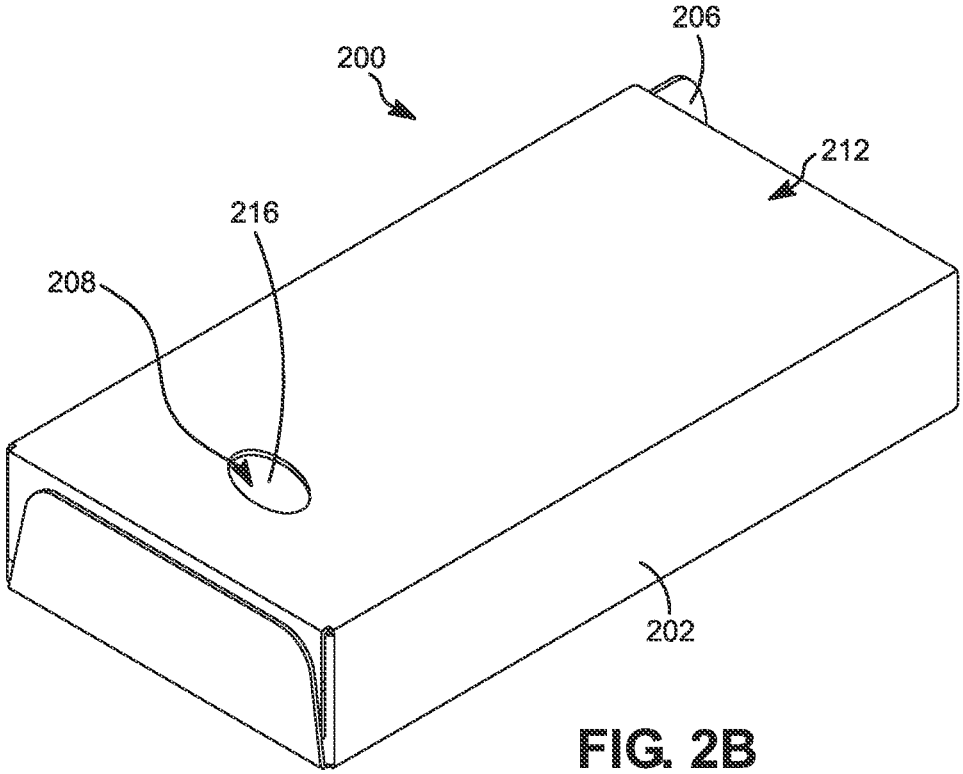
FIG. 2B illustrates a perspective bottom view of an example packaging apparatus in a closed position.

FIG. 2B illustrates a perspective bottom view of the example packaging apparatus 200. The outer sleeve 202, the inner sleeve 204, and the pull tab 206 are shown. An aperture 208 is located in a bottom panel 212 in the outer sleeve. As shown, the aperture is oval-shaped. The oval shape is intended to accommodate for a user's finger to access inside the outer sleeve and to prevent tampering, which may occur with a square shape, for example. However, in other implementations, the aperture 208 may be other shapes. The size of the aperture is configured to be small enough to prevent a user's finger or fingernails from tearing the packaging apparatus. In some implementations, the aperture 208 may be approximately ½-inch wide and approximately ¼-inch tall, by way of example, but the sizes may vary.

When in the packaging apparatus 200 is in a closed position, the packaging apparatus 200 is locked, where the inner sleeve 204 is locked inside the outer sleeve 202. To open the packaging apparatus 200, a user can press downward on a locking tab 216 on the inner sleeve 204 that is accessible via the aperture 208. When the locking tab 216 on the inner sleeve 204 is pressed downward, the locking tab 216 on the inner sleeve 204 moves and disengages from a locking ridge located on an interior middle panel (or glue lap) of the outer sleeve (shown and described in detail in FIGS. 5 and 6 below), and unlocks the inner sleeve 204 from the outer sleeve 202. The inner sleeve 204 can then be pulled from the outer sleeve 202.

As shown in FIG. 2B, the aperture 208 is located approximately ⅛ inch from an end of the outer sleeve 202. While the exact location and measurement of the aperture may vary, the location of the aperture in the bottom panel 212 is far enough from the end of the outer sleeve 202 that the locking tab 216 of the inner sleeve 204 can be accessed and disengaged from a locking ridge, and close enough to the end of the outer sleeve 202 that a user (e.g., a child) cannot see the locking mechanism (the end of the locking tab of the inner sleeve interfacing the locking ridge).

In some implementations, the packaging apparatus 200 may have a second locking mechanism (described in detail in FIG. 5B below) that prevents the inner sleeve 204 from being pulled out its entirety out of the outer sleeve 202, and keeps the inner sleeve 204 connected to the outer sleeve 202.

Figure 2C:
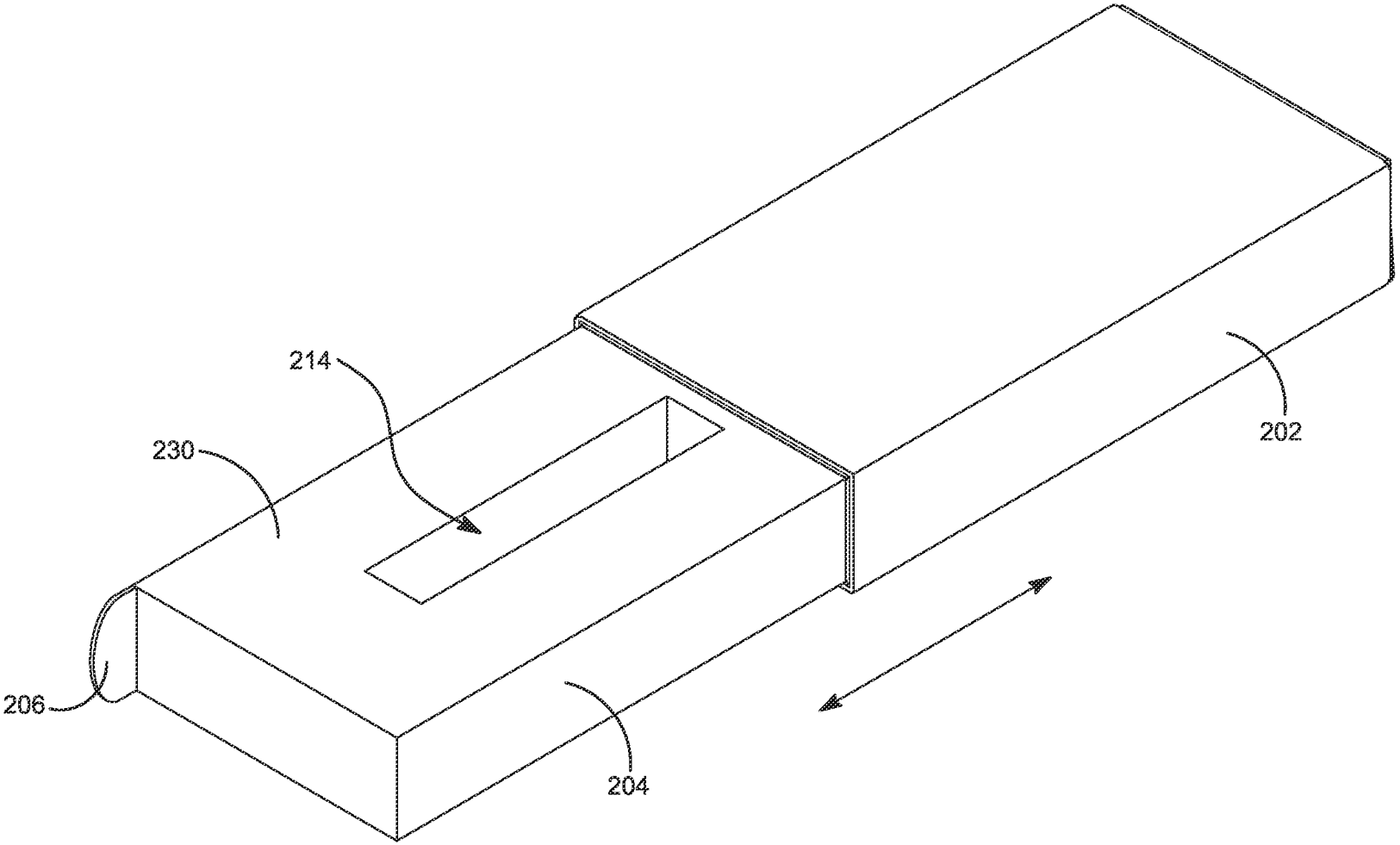
FIG. 2C illustrates a perspective top view of an example packaging apparatus in an open position.

Referring to FIG. 2C, the packaging apparatus 200 is shown in an open position where the inner sleeve 204 is connected to the outer sleeve 202. The arrow shows the direction that the inner sleeve 204 may be moved in and out of the outer sleeve 202. In some implementations, the inner sleeve 204 may be connected to the outer sleeve 202 via a second locking mechanism. The pull tab 206 connected to the inner sleeve 204 is shown.

The inner sleeve 204 has an inner sleeve compartment 214 located in a top panel 230 which acts as a storage compartment for holding items in place and for storing items in the outer sleeve 202. The inner sleeve compartment 214 can vary in design, size, and shape depending on the design and use of the packaging apparatus 200, as well as the required design for desired items to be stored in the outer sleeve 202. For example, the inner sleeve compartment 214 may be designed to securely hold vials, bottles, a vape cartridge, electronic cigarettes, food products, other objects, etc. in place. In some implementations, there may be multiple compartments. The inner sleeve compartment 214 may be defined by a number of panels configured in a single sheet of stock or packaging that makes up the inner sleeve 204 (shown and described in FIG. 4B).

Specifically, the compartment panels (top compartment panels, a compartment bottom panel, compartment side panels, and a middle panel of the inner sleeve) are located adjacent to exterior inner sleeve panels in a sheet of stock and configure to make the inner sleeve compartment 214. The compartment panels can form side walls, a top panel of the inner sleeve compartment 214, and a bottom panel of the inner sleeve compartment 214 that are positioned over the middle panel of the inner sleeve. Once the inner sleeve compartment 214 is constructed, the two compartment side panels form partitions in the inner sleeve 204 that form three tube-like compartments that run the length of the inner sleeve as well as add two additional walls in the inner sleeve 204 for added structural integrity. One of the tube-like compartments becomes the inner sleeve compartment and the other two tube-like compartments are not accessible from the outside of the packaging apparatus. In some implementations, the inner sleeve does not have an end panel and the three compartments are open, to conserve on packaging material. This open end of the inner sleeve faces inside the outer sleeve when the inner sleeve is inserted into the outer sleeve.

Contents or storage items are stored in the inner sleeve compartment 214. In some implementations, contents may be kept in place by a perforated top panel (e.g., see perforated top panel 368 in FIG. 4B). For example, the perforated top panel may be configured to separate in the middle (e.g., the line in the middle of the panel) into two separate pieces or panels and bend at various desired perforations (e.g., at one or more of the other six perforation lines shown) into the inner sleeve compartment 214 to create an automatic cradle and secure fitting for a content to be stored.

In some implementations, there may be one or more aperture located in the top panel(s) 468 to receive a storage item to further secure it in place in the inner sleeve compartment 214. The top panel(s) 468 may be configured to move down into the inner sleeve compartment adjacent to the inner compartment sidewalls 476*a* and 476*b*, and in some implementations, contacting a bottom panel of the compartment 484.

The components of the packaging apparatus 200 can comprise of one or more materials (i.e., paperboard, wax paper, aluminum foil, cellophane, plastic, thermoformed plastic material such as polystyrenes, polypropylenes, polyethylenes, polyethylene terephthalates, polyvinyl chloride polystyrenes, polyvinylydene chlorides, fluoride resins, polycarbonates, polyamides, polyphenylene oxides, and combinations thereof, etc.), and of varying measurements, depending on the storage requirements for the storage items. For example, in some implementations, all of the packaging apparatus 200 may be paperboard of varying thickness. In some implementations, the interior walls of the outer sleeve 202 may have a lining or tray made of a material different than the outer sleeve 202. For example, the outer sleeve 202 may be made of paperboard, and a lining on the interior walls of the outer sleeve 202 may be plastic or another material that cannot be ripped or torn, reinforcing the child-resistant nature of the packaging apparatus 200. Or, in another implementation, the inner sleeve 204 may be made of both a plastic material and a paperboard material to provide additional durability.

In some implementations, the packaging apparatus may include silicone to minimize the risk of moisture build-up, or parchment paper if storage items are sticky, or other materials which may provide an airtight or moisture-free environment or prevent freezing or other temperature change. Other materials are contemplated that prevent against moisture and humidity, direct light, sources of heat, contamination, mildew or mold, and bugs.

In some implementations, scoring of the components may allow for memory, and different thicknesses of material may be used for rigidity. In some implementations, plastic laminate may be included in the packaging apparatus so that the packaging is tear-proof.

In some implementations, the packaging apparatus includes at least one additional interior locking mechanism (described in detail in FIG. 5) configured to lock the inner sleeve 204 to the outer sleeve 202 in both open and closed configurations.

Figure 3A:
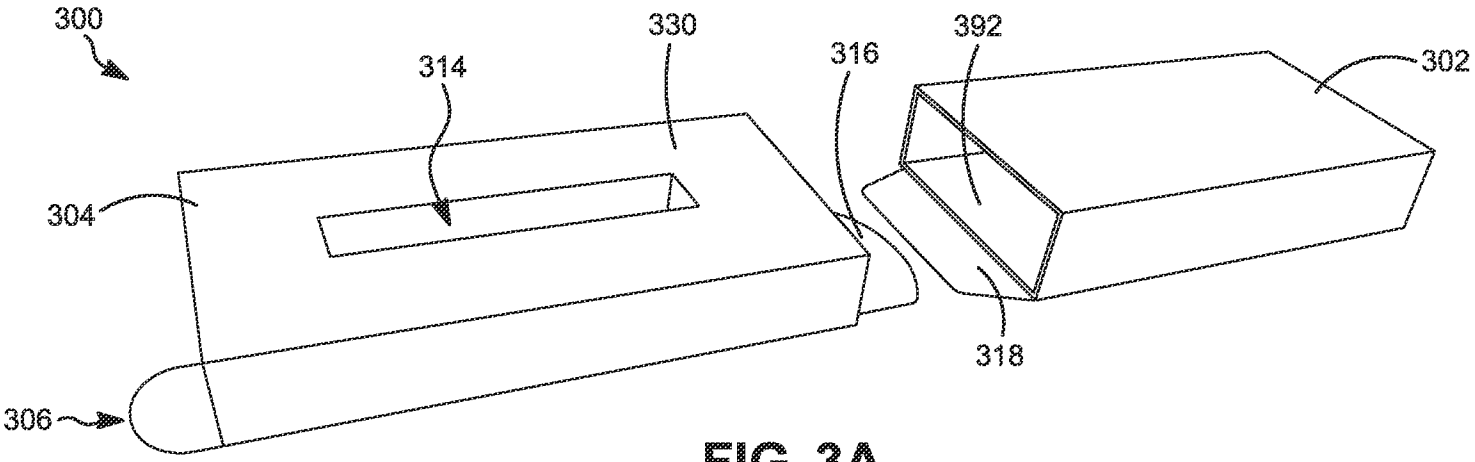
FIGS. 3A-D illustrates perspective views of an example packaging apparatus during assembly.

FIGS. 3A-D illustrate perspective views of example packaging apparatus 300 during assembly. FIG. 3A illustrates the outer sleeve 302 separated from the inner sleeve 304 before assembly. A locking tab 318 on the outer sleeve 302 is connected to an end of the bottom panel of the outer sleeve 312. The inner sleeve 304 has an inner sleeve compartment 314 shown in the top panel of the inner sleeve 330. A locking tab on the inner sleeve 316 is connected to an end of the inner sleeve 304. A pull tab 306 is also shown on the inner sleeve 304.

Figure 3B:
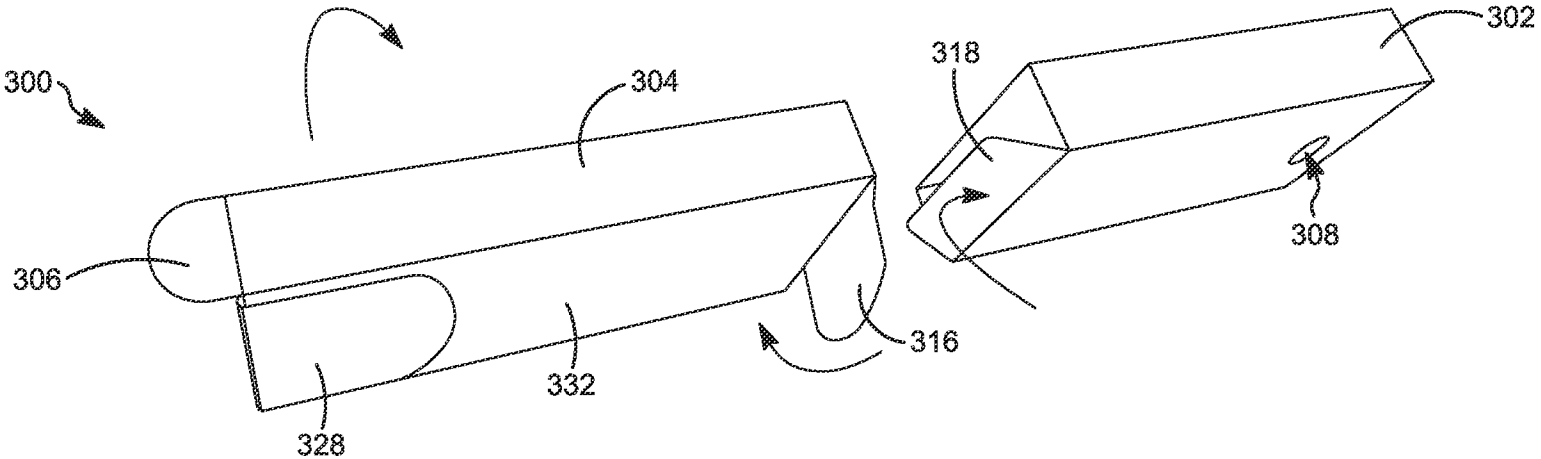

FIG. 3B illustrates that the locking tab of the inner sleeve 316 connected to the inner sleeve 304 may be pressed down and rotated around, or backward, in a direction to lay approximately adjacent or substantially parallel to an exterior surface of a bottom panel of the inner sleeve 304. The locking tab of the outer sleeve 318 located on the end of the outer sleeve 302 may be moved upward and pressed into the inside of the outer sleeve 308 to lay approximately adjacent or substantially parallel to the interior surface of a panel (e.g., see a glue lap or middle panel 492 located on the bottom panel, shown in FIG. 3A) of the outer sleeve 302. Once the inner sleeve 304 is fully inserted into the outer sleeve 302, a first locking mechanism locks the inner sleeve 304 inside the outer sleeve 302.

Figure 3C:
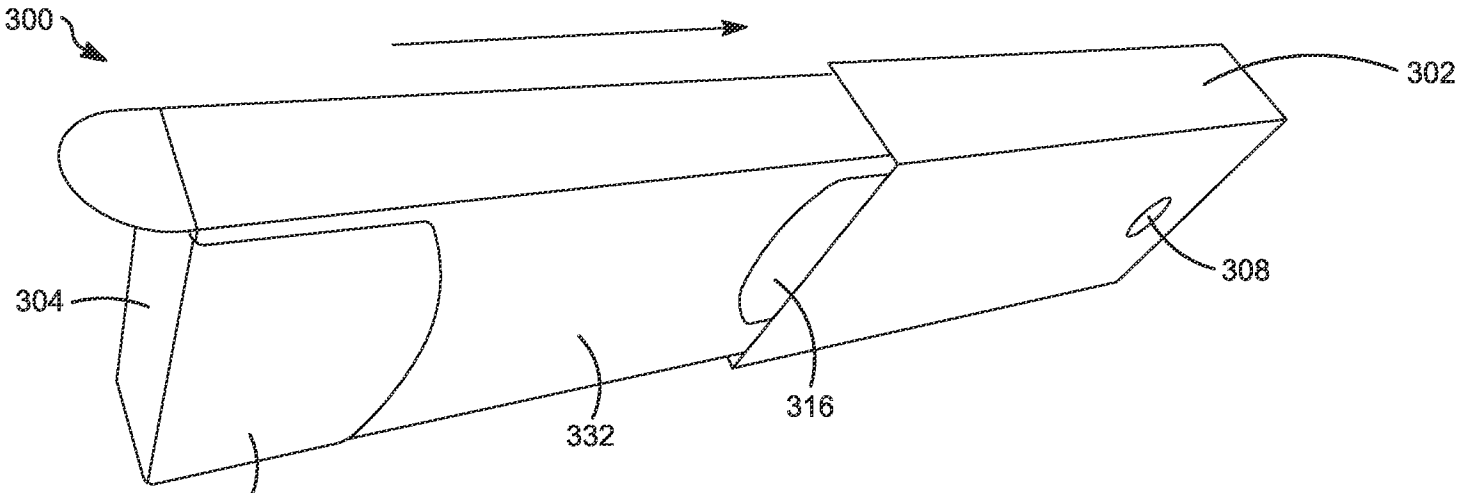

FIG. 3C illustrates the inner sleeve 304 being inserted into the outer sleeve 302, as the locking tab of the inner sleeve 316 connected to the inner sleeve 304 is positioned approximately adjacent or substantially parallel to a bottom panel 332 of the inner sleeve 304, and the locking tab of the outer sleeve 318 on the outer sleeve 302 is positioned inside the outer sleeve 302 approximately adjacent or substantially parallel to a glue lap or middle panel of the outer sleeve (not shown) located on the interior surface of a bottom panel of the outer sleeve 302.

Figure 3D:
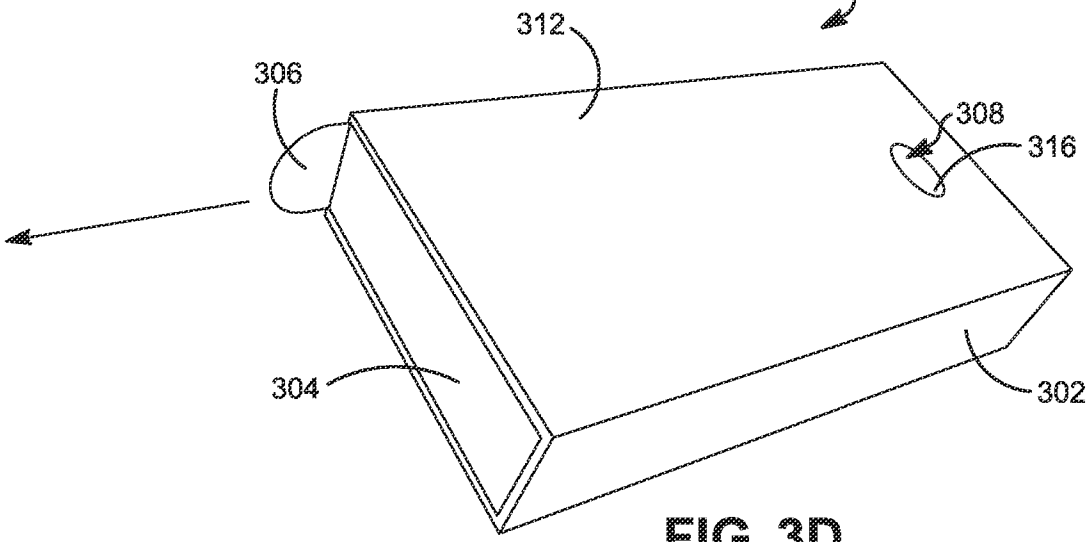

FIG. 3D illustrates the inner sleeve 304 inserted in the outer sleeve 302. The locking tab of the inner sleeve 316 connected to the inner sleeve 304 is shown accessible through the aperture 308 located in the bottom panel of the outer sleeve 312. To open the packaging apparatus 300, a user can unlock the locking tab of the inner sleeve and pull the pull tab 306 of the inner sleeve 304 to slide the inner sleeve 304 from the outer sleeve 306.

Figure 4A:
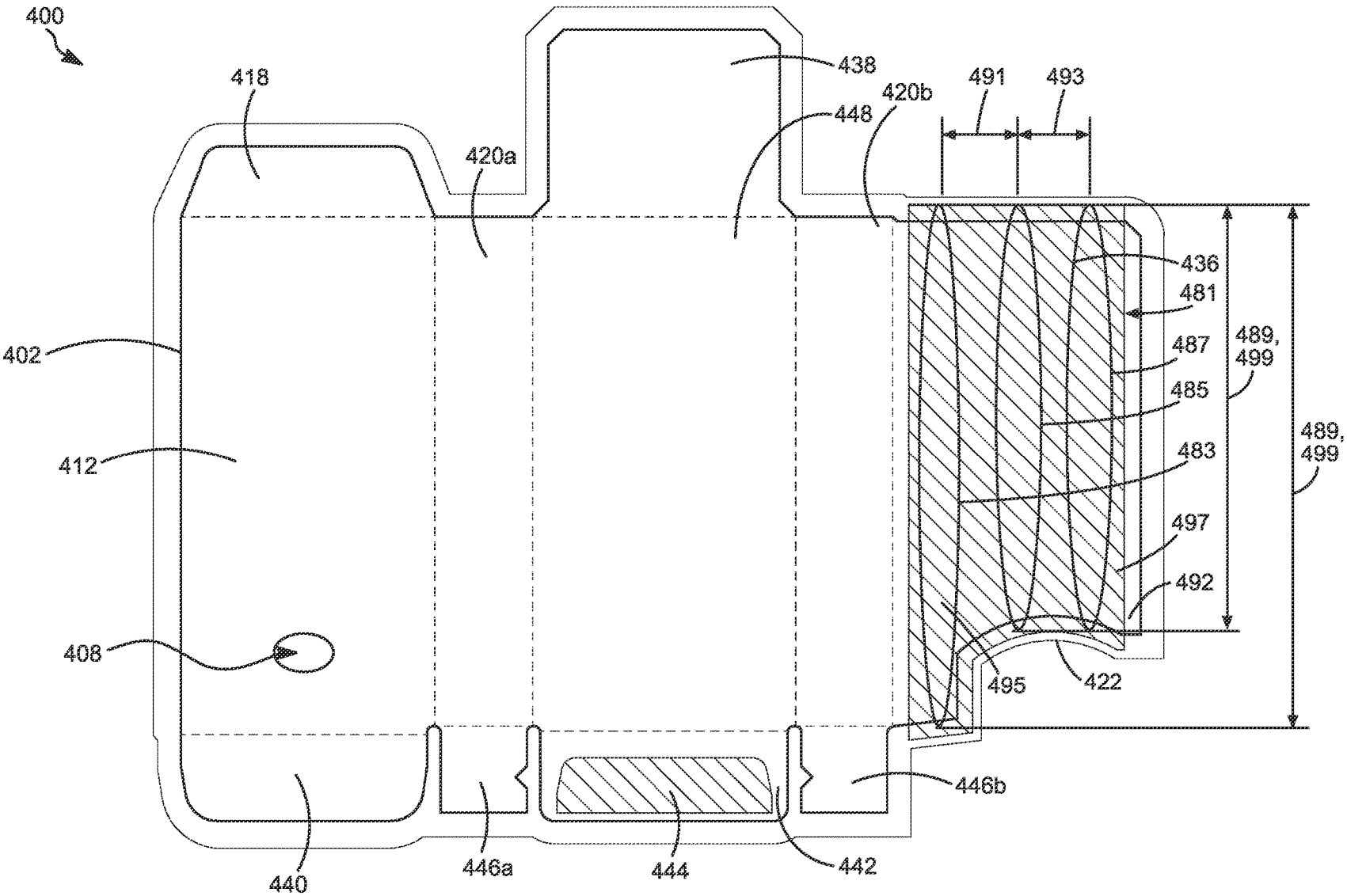
FIG. 4A illustrates a plan view of an unassembled example outer sleeve of a packaging apparatus.

FIG. 4A illustrates a plan view of an unassembled example outer sleeve 402 of a packaging apparatus 400. The plan view of the outer sleeve 402 is an example, and there may be variations on how the outer sleeve 402 is assembled. The outer sleeve 402 includes several panels that can be folded onto each other to create rectangular packaging with one open end. As shown, the unassembled example outer sleeve 402 is a single sheet of packaging material that includes panels, tabs and dust flaps.

A first layer of adhesive 436 of the outer sleeve 402 is shown as applied to a first glue lap 492, an interior panel of the outer sleeve 402. A "glue lap" may be referred to as a packaging panel or extra stock in which glue or other adhesive is applied in order to attach the glue lap to another panel or surface in the packaging apparatus 400. Glue laps may be added to packaging for various reasons, including for extra reinforcement to packaging, to create compartments, and to act as locking mechanisms. For purposes of this disclosure, a glue lap may also be defined as a particular panel. For example, the first glue lap 492 is also the middle panel in the outer sleeve 402. As described below, during assembly, the first glue lap 492 folds onto the bottom panel 412 of the outer sleeve 402 and the first layer of adhesive 436 of the outer sleeve 402 seals the first glue lap 492 onto the interior surface of the bottom panel of the outer sleeve 412. As shown in the figures and described herein, a "layer of adhesive" is depicted as where the layer of adhesive is applied on a given panel of the single sheet of packaging material, and the area upon which the panel will seal to another panel or packaging surface.

In the illustrated embodiment, the first layer of adhesive 436 of the outer sleeve 402 includes at least two glue lines 481. More specifically, in the illustrated embodiment, the first layer of adhesive 436 of the outer sleeve 402 includes at least three glue lines 481. The glue lines 481 include a first glue line 483, a second glue line 485, and a third glue line 487 and the glue lines 481 each have a glue line length 489. Additionally, a first glue line distance 491 is defined as the distance between the first glue line 483 and the second glue line 485, and a second glue line distance 493 is defined as the distance between the second glue line 485 and the third glue line 487. Moreover, the first glue lap 492 includes a first portion 495 and a second portion 497 each having a glue lap length 499. The first glue lap length 499 of the first portion 495 is longer than the first glue lap length 499 of the second portion 497 such that the second portion 497 defines a locking ridge or edge 422 as described below.

The first glue line 483 is positioned on the first portion 495 and the second glue line 485 and the third glue line 487 are positioned on the second portion 497. The glue line length 489 of the first glue line 483 is substantially equal to the first glue lap length 499 of the first portion 495 such that the first glue line 483 extends from end-to-end of the first portion 495. Additionally, the glue line lengths 489 of the second glue line 485 and the third glue line 487 are substantially equal to the first glue lap length 499 of the second portion 497 such that the second glue line 485 and the third glue line 487 extend from end-to-end of the second portion 497. In the illustrated embodiment, the first glue lap length 499 of the first portion 495 is about 9.0 centimeters (cm) to about 14.3 cm, the first glue lap length 499 of the second portion 497 is about 7.0 cm to about 12.1 cm, the glue line length 489 of the first glue line 483 is about 8.6 cm to about 13.9 cm, the glue line length 489 of the second glue line 485 is about 6.7 cm to about 11.8 cm, and the glue line length 489 of the third glue line 487 is about 6.7 cm to about 11.8 cm. In alternative embodiments, the first glue lap length 499 of the first portion 495, the first glue lap length 499 of the second portion 497, the glue line length 489 of the first glue line 483, the glue line length 489 of the second glue line 485, and the glue line length 489 of the third glue line 487 may be any length that enables the packaging apparatus 200 to operate as described herein.

Additionally, the first glue line distance 491 and the second glue line distance 493 are arranged such that the first, second, and third glue lines 483 are spaced evenly across the first glue lap 492. Specifically, in the illustrated embodiment, the first glue line distance 491 is substantially equal to the second glue line distance 493. In alternative embodiments, the first glue line distance 491 is greater than the second glue line distance 493 or the second glue line distance 493 is greater than the first glue line distance 491. In the illustrated embodiment, the length of the first glue line distance 491 and the second glue line distance 493 are about 1.6 cm to about 1.9 cm. In alternative embodiments, the length of the first glue line distance 491 and the second glue line distance 493 may be any length that enables the packaging apparatus 200 to operate as described herein.

The glue lines 481 are configured to strengthen the outer sleeve 202 and improve the child resistance of the packaging apparatus 200. Specifically, a typical packaging system would typically only include the first glue line 483 positioned on the first portion 495. The outer sleeve 202 described herein further includes the second glue line 485 and the third glue line 487 to strengthen the bond between the first glue lap 492 and the interior surface of the bottom panel of the outer sleeve 412. The first glue lap 492 of the outer sleeve 202 is wider than typical packaging flaps and the glue lines 481 provide additional adhesion between the bottom panel 412 of the outer sleeve 202 and the first glue lap 492 of the outer sleeve 202. Thus, the shape of the first glue lap 492 of the outer sleeve 202 and the glue lines 481 strengthen the outer sleeve 202 and improve the child resistance of the packaging apparatus 200.

Additionally, in the illustrated embodiment, the first glue lap 492 includes two ovals 471 printed on the first glue lap 492 that indicate where the second glue line 485 and the third glue line 487 are to be dispensed on the first glue lap 492. The ovals 471 enable an operator to quickly check whether a folder/gluer 1000 (illustrated in FIGS. 10-11) is dispensing the second glue line 485 and the third glue line 487 in the proper locations relative to the first glue line 483 and the first glue lap 492. The ovals 471 ensure that the second glue line 485 and the third glue line 487 are repeatably positioned in the proper locations in order to strengthen the outer sleeve 202 and improve the child resistance of the packaging apparatus 200.

The locking tab of the outer sleeve 418 is connected to an end of the bottom panel of the outer sleeve 412. The locking tab of the outer sleeve 418 has memory properties. During use of the packaging apparatus 400, the locking tab of the outer sleeve 418 may be moved inside the outer sleeve 402 to form part of a second locking mechanism when the inner sleeve 404 is moved from the outer sleeve 402 (described in detail in FIG. 5B).

A reinforcement panel of the outer sleeve 438 may also be folded into the interior of the outer sleeve 402. In some implementations, the reinforcement panel of the outer sleeve 438 is glued against the top panel outer sleeve 448. The reinforcement panel of the outer sleeve 438 wraps around the end of the outer sleeve so that the edges of the outer sleeve 402 are rounded (rather than square), which prevents tampering of the packaging apparatus.

Dust flaps 446*a* and 446*b* are located adjacent to the side panels 420*a* and 420*b*. As shown, the dust flaps 446*a* and 446*b* have cut-outs for die-cutting to provide for clearance with adjacent panels and to decrease any gap size between panels once the end panels are folded during assembly.

To assemble the outer sleeve 402, the first glue lap of the outer sleeve 492 is folded into the outer sleeve 402, where the first glue lap of the outer sleeve 492 is located opposite the top panel of the outer sleeve 448 and the side panel 420*b* forms one side to the outer sleeve 402. The bottom panel of the outer sleeve 412 is folded on top of the first glue lap of the outer sleeve 492 attaching via the first adhesive of the outer sleeve 436. The side panel 420*a* forms a second side to the outer sleeve 402. The side panels 420*a* and 420*b* are perpendicular to the first glue lap of the outer sleeve 492, the bottom panel of the outer sleeve 412, and the top panel of the outer sleeve 448.

Once the outer walls (e.g., top panel of the outer sleeve 448, bottom panel of the outer sleeve 412, side panels 420*a* and 420*b*, and the first glue lap of the outer sleeve 492) are assembled, the dust flaps 446*a* and 446*b* are folded inside the outer sleeve 402, and a first end flap 440 is folded to close an end of the outer sleeve 402. A second glue lap 442 may be folded onto the first end flap 440 and secured to the first end flap 440 with a second layer of adhesive of the outer sleeve 444. The dust flap 446*a* and 446*b*, fourth flap 440, and second glue lap 442, in combination together, create a "dog-eared tuck" located on the end of the outer sleeve 402, which is a permanently fixed and child-resistant end of the packaging, which requires tearing to open the packaging apparatus 400 once it is closed and locked.

The locking ridge or edge 422 is configured on the first glue lap 492. A locking ridge or edge 422 is an edge located on the end of the first glue lap 492 proximate to the bottom panel of the outer sleeve 412. Once the packaging apparatus 400 is assembled, after the inner sleeve 404 is inserted into the outer sleeve 402, and during use, the packaging apparatus is in a closed configuration. A locking tab of the inner sleeve 416 can latch, engage, or otherwise "lock" onto the locking ridge 422 and lock the inner sleeve 404 inside the outer sleeve 402 (described in more detail below). When the locking tab of the inner sleeve 416 of the inner sleeve 404 has latched onto the locking ridge 422, a user is prevented from pulling the inner sleeve 404 out of the outer sleeve 402.

Figure 4B:
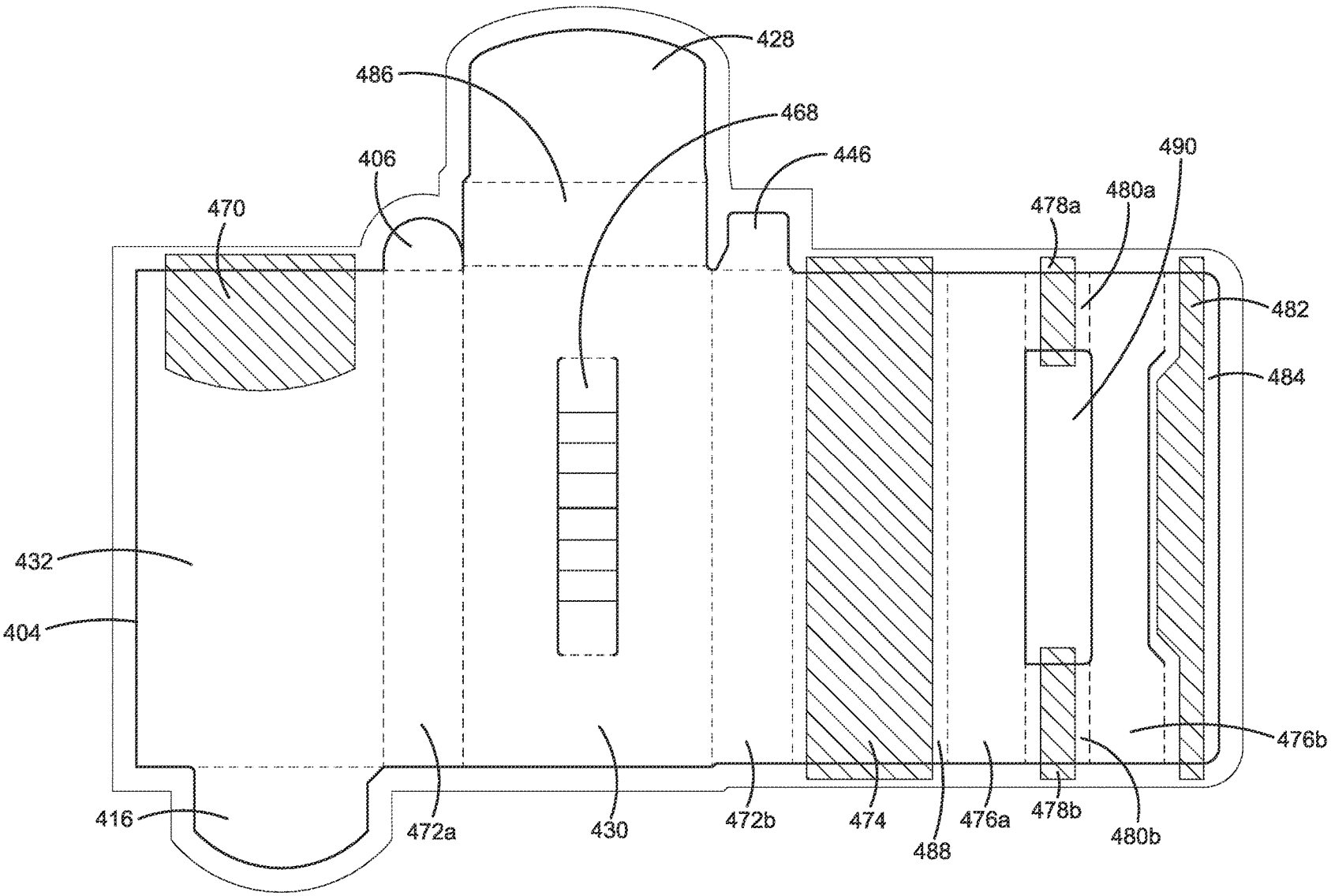
FIG. 4B illustrates a plan view of an unassembled example inner sleeve of a packaging apparatus.

FIG. 4B illustrates a plan view of an unassembled example inner sleeve of a packaging apparatus 400. The plan view of the inner sleeve 404 is an example, and there may be variations on how the inner sleeve 404 is assembled. The inner sleeve 404 includes several panels that can be folded onto each other to create rectangular packaging. In some implementations, the inner sleeve has one open end. As shown, the unassembled example inner sleeve 404 is a single sheet of packaging material that includes panels, tabs, and dust flaps.

A top panel of the inner sleeve 430 is shown with the bottom panel of the inner sleeve 432 with two side panels 472*a* and 472*b*. The bottom panel of the inner sleeve 432 is shown with a first adhesive of the inner sleeve 470 located on an end. The inner sleeve 404 has a pull tab 406, and an end panel of the inner sleeve 486. A locking tab of the inner sleeve 416 is shown attached to the end of the bottom panel of the inner sleeve 432. The reinforcement panel of the inner sleeve 428 is shown attached to an end panel of the inner sleeve 486, which is attached to the top panel of the inner sleeve 430. A compartment panel 468 is located in the top panel of the inner sleeve 430.

The side panel of the inner sleeve 472*b* is connected to components that make up the inner compartment 214, shown in FIG. 2C. Specifically, the side panel of the inner sleeve 472*b* is connected to a middle panel of the inner sleeve 488, which is shown with a second layer of adhesive of the inner sleeve 474. The middle panel of the inner sleeve 488 is connected to a compartment sidewall 476*a*.

The compartment sidewall 476*a* is connected to components compartment top panels 480*a* and 480*b*, which are separated from each other by a compartment aperture 490. Third layers of adhesive of the inner sleeve 478*a* and 478*b* are located on top of the two compartment top panels 480*a* and 480*b*, respectively. The two compartment top panels 480*a* and 480*b* are attached to a compartment sidewall 476*b*, which is attached to a bottom panel of the compartment 484. A fourth layer of adhesive of the inner sleeve 482 is located on the bottom panel of the compartment 484.

When assembled, an inner sleeve compartment (e.g., inner sleeve compartment 214 shown in FIG. 2C) is created by the bottom panel of the compartment 484 folding or rolling into the inner sleeve 404 where the bottom panel of the compartment 484 attaches and seals via the fourth layer of adhesive of the inner sleeve 404 onto the middle panel of the inner sleeve 488. The middle panel of the inner sleeve 488 is folded and sealed onto the interior surface of the bottom panel of the inner sleeve 432 via the second layer of adhesive of the inner sleeve 474. The top panel of the inner sleeve 430 may be folded onto the top of the third layers of adhesive of the inner sleeve 478*a* and 478*b* securing the top panel of the inner sleeve 430 to the top panels of the compartment 480*a* and 480*b*.

The bottom panel of the inner sleeve 432 folds and seals onto middle panel of the inner sleeve 488 via a second adhesive of the inner sleeve 474.

The tab or dust flap 446 is then folded in toward the inside of the inner sleeve 404 and the end panel 486 of the inner sleeve 432 wraps around the tab 446. The reinforcement panel of the inner sleeve 428 wraps around to the exterior surface of the bottom panel of the inner sleeve attaching and sealing to the first layer of adhesive of the inner sleeve 470, sealing the end of the inner sleeve 404. The reinforcement panel of the inner sleeve 428 wraps around the end of the inner sleeve 404 so that the edges of the closed end of the outer sleeve 402 are rounded (rather than square), which prevents tampering of the packaging apparatus.

As shown in FIGS. 4A and 4B, the locking tab of the inner sleeve 416 and the locking ridge 422 are both arc-shaped.

When the packaging apparatus 400 is assembled and in a closed configuration with the inner sleeve 404 entirely inserted into in the outer sleeve 402, the arc-shaped end of the locking tab of the inner sleeve 416 and the arc-shaped end of the locking ridge 422, which are inverse cut-outs of each other, nest opposite one another and together are fighting edges that lock the packaging apparatus 400.

Figure 5A:
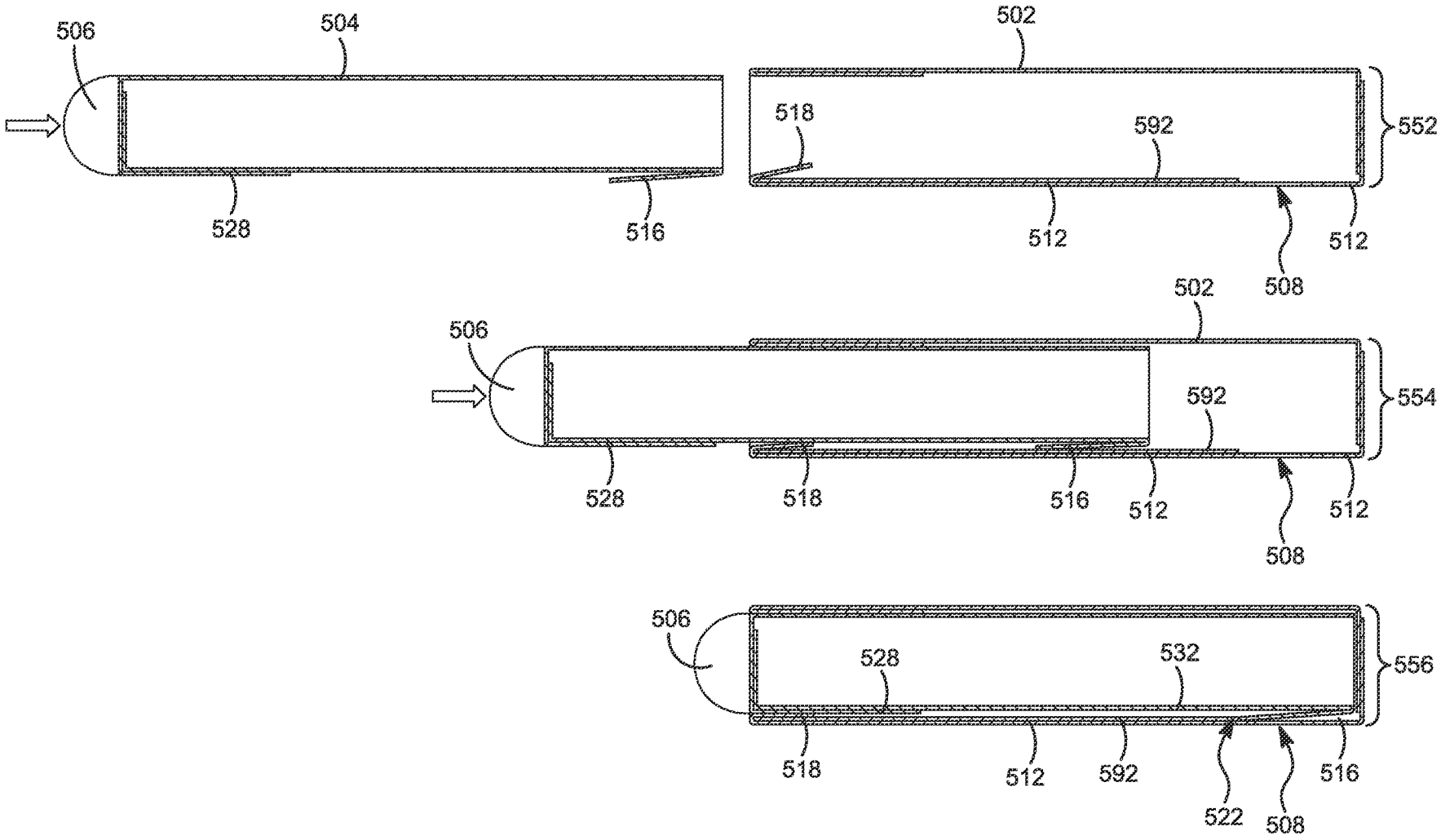
FIGS. 5A and 5B illustrates side cross-sectional views of an example packaging apparatus during assembly and use.
Figure 5B:
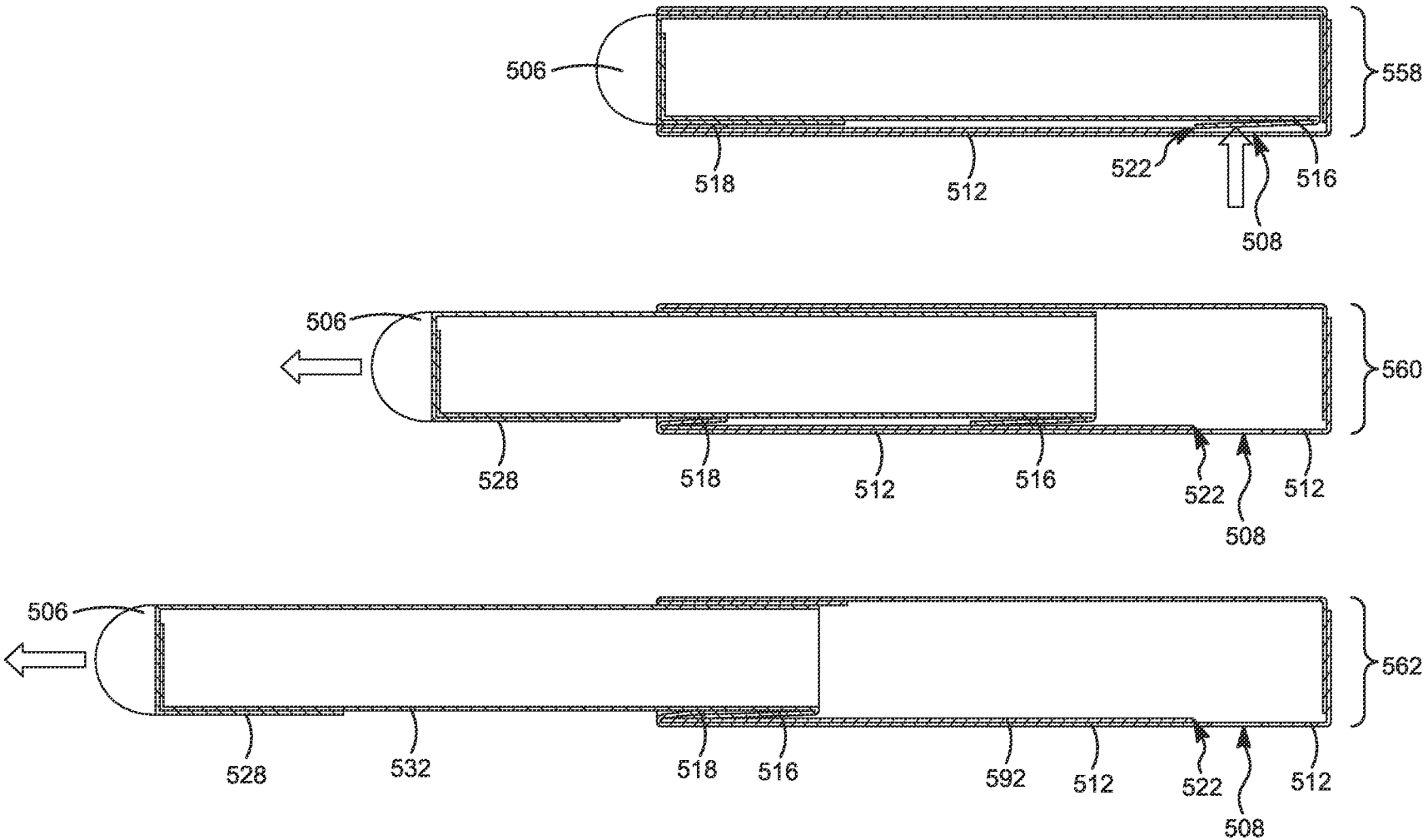

FIGS. 5A and 5B illustrate side cross-sectional views of an example packaging apparatus during various steps 552-562 of assembly and use. In a step 552, the inner sleeve 504 is shown detached from the outer sleeve 502 prior to assembly of the packaging apparatus 500. Prior to inserting the inner sleeve 504 into the outer sleeve 502 to assemble the packaging apparatus 500, the locking tab on the inner sleeve 516 may be positioned approximately adjacent or substantially parallel to the exterior surface of the bottom panel 532 of the inner sleeve 504. The locking tab of the outer sleeve 518 may be pushed inside the outer sleeve 502 and positioned approximately adjacent or substantially parallel to the first glue lap 592 located on the interior surface of a bottom panel 512 of the outer sleeve 502. In a step 554, the inner sleeve 504 is shown partially inserted into the outer sleeve 502, where when the inner sleeve 504 enters the outer sleeve 502, the locking tab on the inner sleeve 516 stays positioned approximately adjacent or substantially parallel to the exterior surface of the bottom panel 532 of the inner sleeve 504 and the locking tab of the outer sleeve 518 stays positioned approximately adjacent or substantially parallel to the first glue lap 536 located on the interior surface of a bottom panel 512 of the outer sleeve 502.

In a step 556, the inner sleeve 504 is shown entirely inserted into the outer sleeve 502 in a locked position. The locking tab on the inner sleeve 516, which has moved past the first glue lap 536 of the outer sleeve 504, springs into an area (shown in greater detail in FIG. 6) in the outer sleeve 502 adjacent the interior surface of a bottom panel 512 of the outer sleeve 502 due to its memory properties. Once the locking tab on the inner sleeve 516 moves past the first glue lap 536, the locking tab on the inner sleeve 516 locks onto a locking edge 522 on the glue lap 536. As a result, the inner sleeve 504 is locked inside the outer sleeve 502.

In a step 558, the inner sleeve 504 is shown entirely inserted into the outer sleeve 502 in an unlocked position. Specifically, a user can apply pressure to the locking tab on the inner sleeve 516 by inserting either a thumb, finger, key, or other instrument through the aperture 508 located in the bottom panel 512 of the outer sleeve 502 and push the locking tab on the inner sleeve 516 upward into the interior of outer sleeve 502 past the locking edge 522.

Once the locking tab on the inner sleeve 516 clears the locking edge 522, the inner sleeve 502 can be pulled by the pull tab 506 from the outer sleeve 502, opening the packaging apparatus 500. As shown in step 560, the inner sleeve 504 is shown partially pulled out of the outer sleeve 502 in an unlocked position. A user can access contents inside the inner sleeve 504 when the inner sleeve is partially pulled out of the outer sleeve 502.

As the user continues to pull the inner sleeve 504 from the outer sleeve 502, the locking tab on the inner sleeve 516, which is facing in a direction opposite the direction that the locking tab of the outer sleeve 518 is facing, catches on the locking tab of the outer sleeve 518. Specifically, the end of the locking tab 516 slides in between the locking tab of the outer sleeve 518 and the middle panel of the outer sleeve 592 and hooks proximate to the interface where the end of the locking tab of the outer sleeve 518 is connected to the bottom panel of the outer sleeve 512 and adjacent to the middle panel of the outer sleeve 592. As a result, the opposing locking tabs lock against each other, and the inner sleeve 504 is prevented from being entirely pulled out of the outer sleeve 502. The inner sleeve 504 is shown partially pulled out of the outer sleeve 502 in a locked position in a step 562.

Figure 6A:
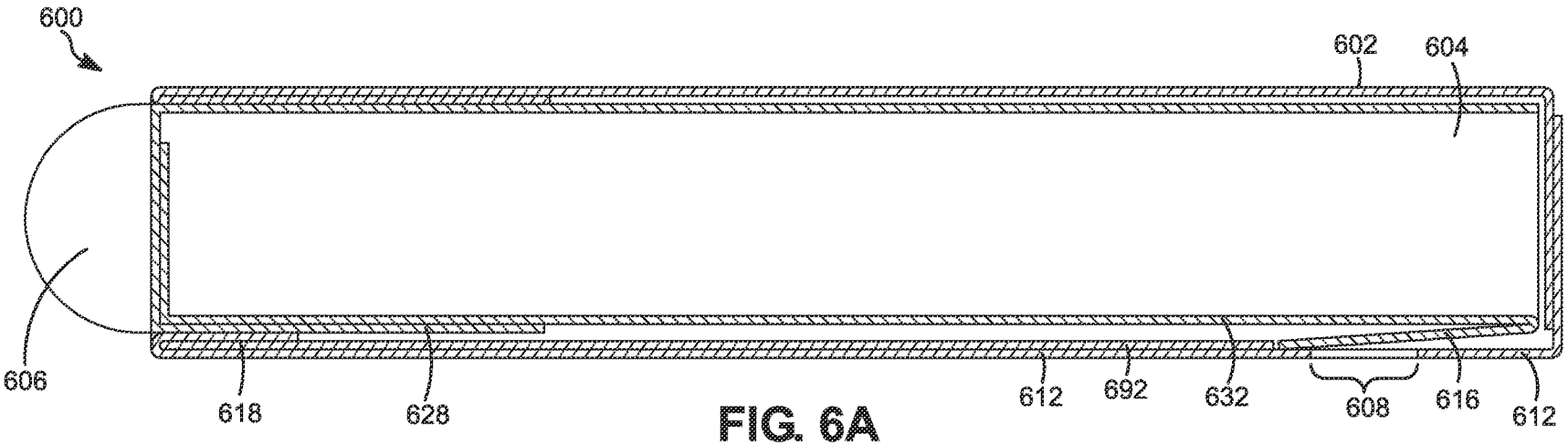
FIGS. 6A and 6B illustrate two enlarged side cross-sectional view of an example packaging apparatus during use.
Figure 6B:
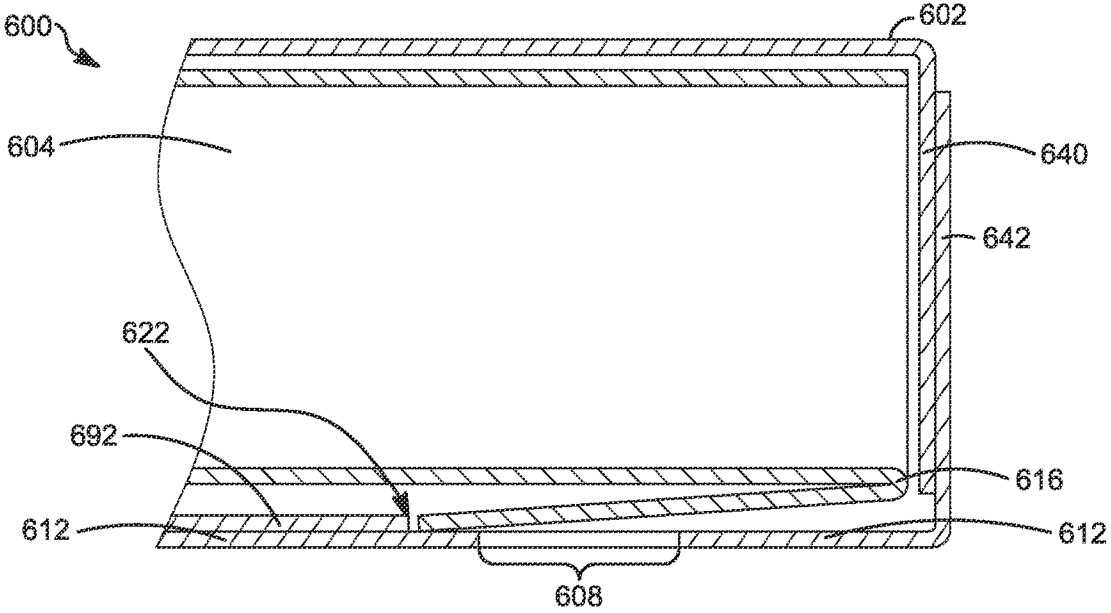

FIGS. 6A and 6B illustrate enlarged, side cross-sectional views of an example packaging apparatus during use in step 556 of FIG. 5, where the packaging apparatus is in a closed configuration by the first locking mechanism. The inner sleeve 604 is shown entirely inserted into the outer sleeve 602 in a locked position. The locking tab on the inner sleeve 616, has moved past the first glue lap 692 of the outer sleeve 604, into an area in the outer sleeve 602 adjacent the interior surface of a bottom panel 612 of the outer sleeve 602 because of its memory properties. The locking tab on the inner sleeve 616 has moved past the first glue lap 636 and locked onto a locking edge 622 on the glue lap 692. As a result, the inner sleeve 604 is locked inside the outer sleeve 602.

To unlock the packaging apparatus 600, a user presses down on the locking tab of the inner sleeve 616 via the aperture 608 and pushes the locking tab 616 into the outer sleeve, disengaging the locking tab of the inner sleeve 616 from the locking edge 622. The inner sleeve can then be pulled from the outer sleeve by the pull tab 606.

Figure 7:
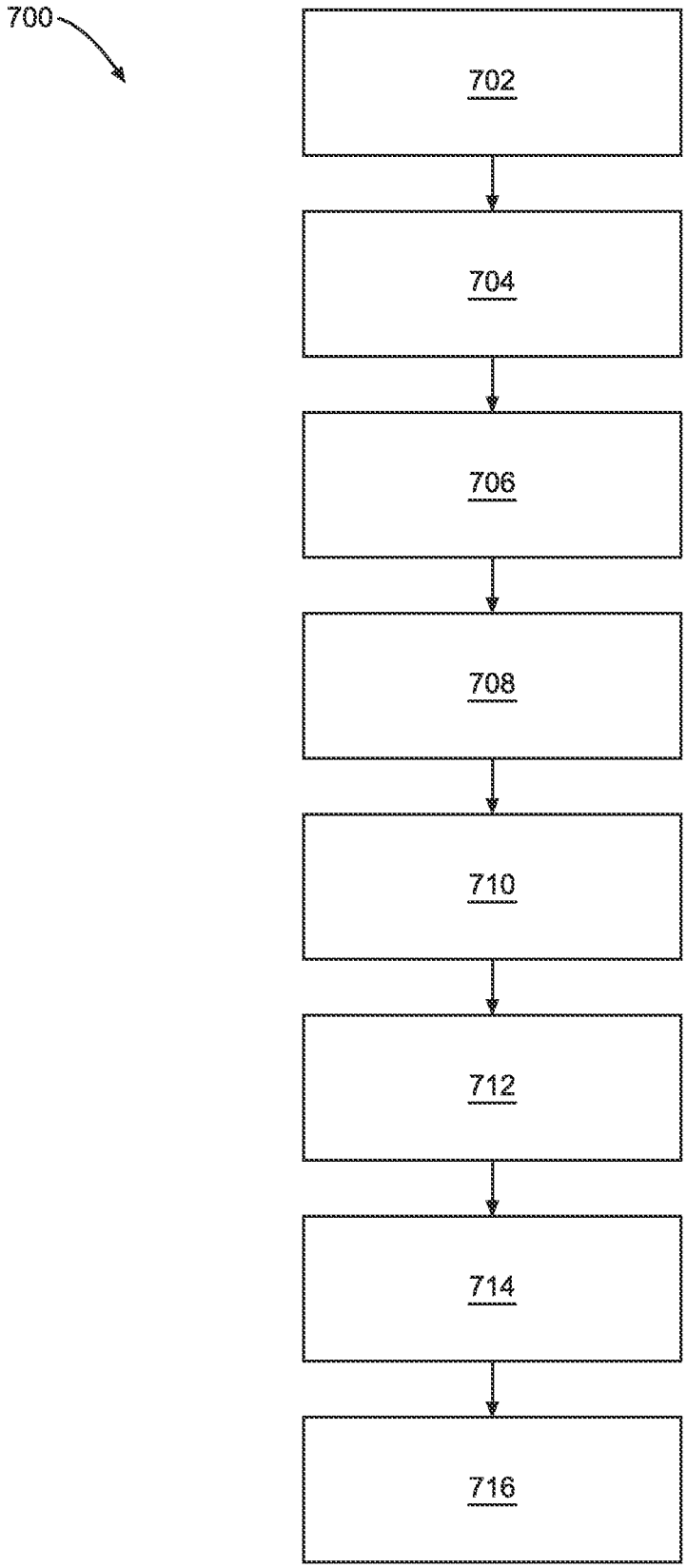
FIG. 7 illustrates a flowchart of an example method of manufacturing a packaging apparatus.
Figure 10:
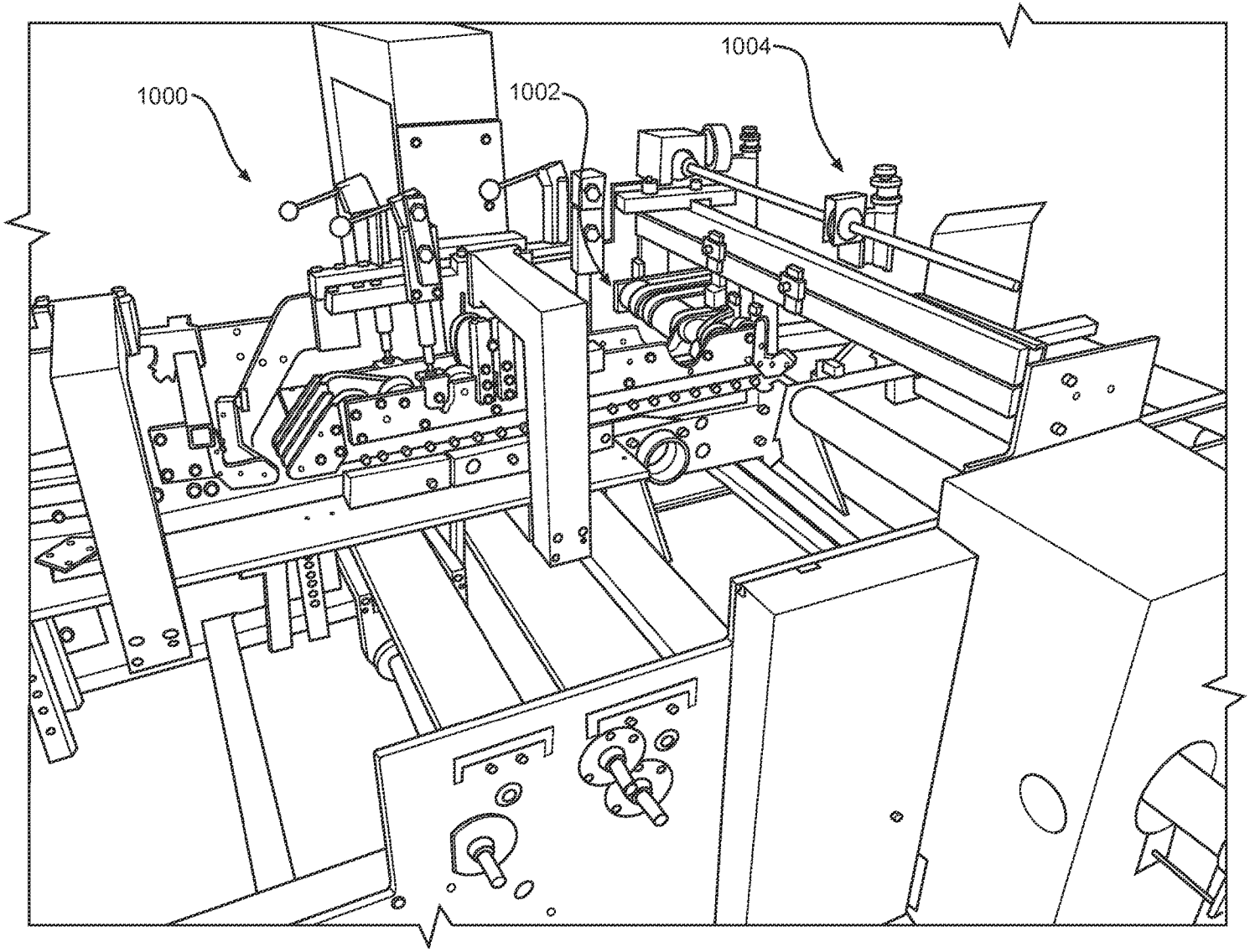
FIG. 10 illustrates an example folder/gluer used to manufacture the packaging apparatus illustrated in FIGS. 2-6.
Figure 11:
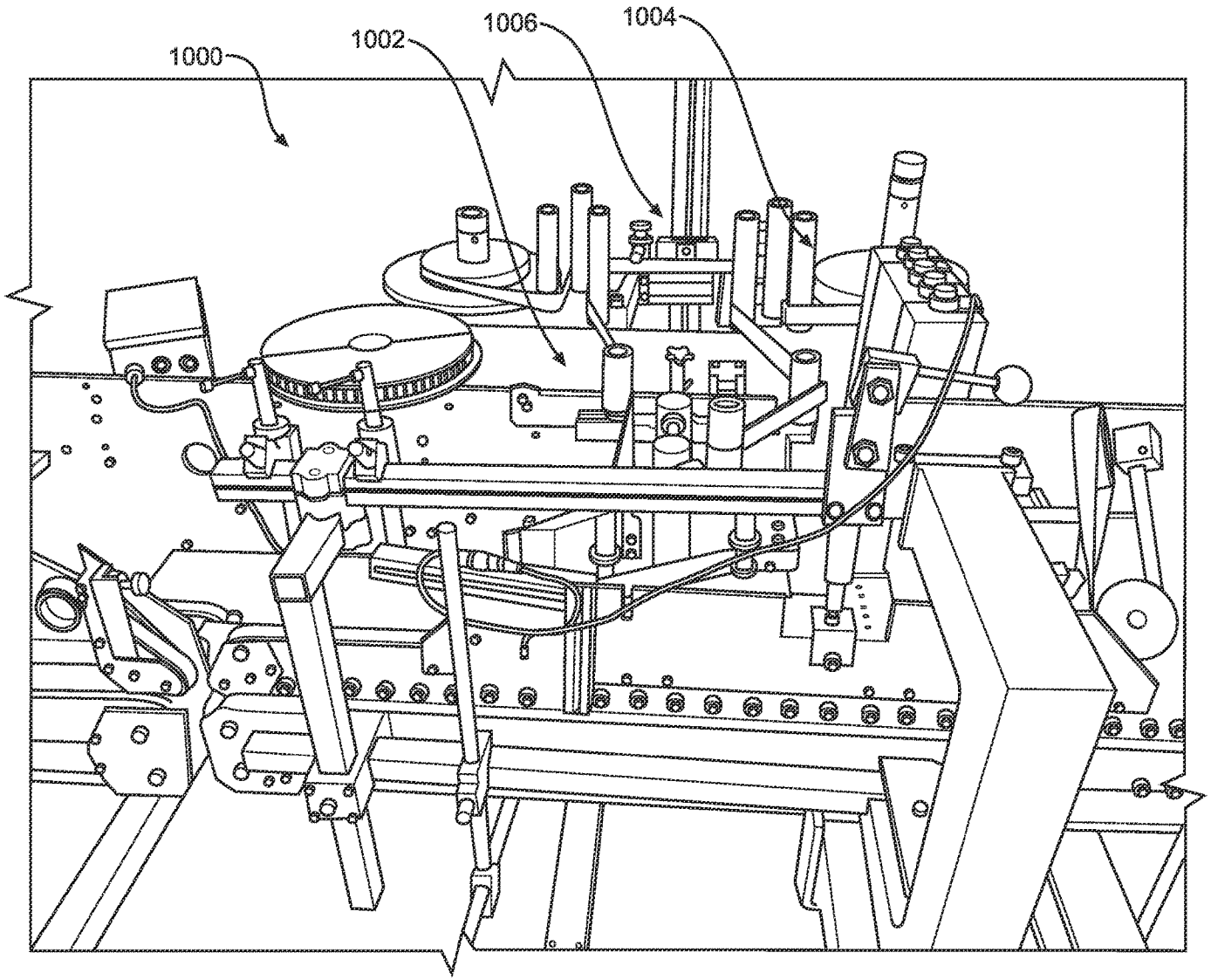
FIG. 11 illustrates the folder/gluer illustrated in FIG. 10 including a labeling station.

Referring to FIG. 7, assembling 700 the outer sleeve 202 includes assembling the outer sleeve 202 using a folder/gluer 1000 illustrated in FIGS. 10-11. The folder/gluer 1000 includes a conveyor 1002 that conveys the outer sleeve 202 to a plurality of stations 1004 that perform a series of operations that assemble the outer sleeve 202 from the precut cartons of the outer sleeve 202. First, assembling 700 the outer sleeve 202 includes receiving 702 the precut cartons of the outer sleeve 202. Receiving 702 the precut cartons of the outer sleeve 202 may include manually stacking the precut cartons of the outer sleeve 202 in a receiving station (not shown) of the folder/gluer 1000 or may include automatically receiving the precut cartons of the outer sleeve 202 into the receiving station (not shown) of the folder/gluer 1000 from the producing and receiving 102 process. Furthermore, receiving 702 the precut cartons of the outer sleeve 202 may include any receiving process that enables assembling 700 the outer sleeve 202.

Next, the precut cartons of the outer sleeve 202 are conveyed by the conveyor 1002 to a prebreak station (not shown) and assembling 700 the outer sleeve 202 also includes prebreaking 704 the precut cartons of the outer sleeve 202. The precut cartons of the outer sleeve 202 may include a plurality of scores, cuts, and/or prefolds that enable the precut cartons of the outer sleeve 202 to be folded along predetermined lines such that the precut cartons of the outer sleeve 202 may be folded and glued into a predetermined shape illustrated in FIGS. 2-6. However, the scores, cuts, and/or prefolds may not enable downstream stations to properly fold the precut cartons of the outer sleeve 202 because the scores, cuts, and/or prefolds may be too stiff. The prebreak station (not shown) prefolds the precut cartons of the outer sleeve 202 prior to conveying the precut cartons of the outer sleeve 202 to downstream stations to ensure downstream stations can properly fold the precut cartons of the outer sleeve 202 into the predetermined shape illustrated in FIGS. 2-6. Additionally, in the illustrated embodiment, the prebreak station configures the precut cartons of the outer sleeve 202 in an orientation to receive a label thereon.

Next, in the illustrated embodiment, the precut cartons of the outer sleeve 202 are conveyed by the conveyor 1002 to a label application station 1006 and assembling 700 the outer sleeve 202 also includes applying 706 a label (not shown) to the precut cartons of the outer sleeve 202. In the illustrated embodiment, the label includes a holographic label that indicates the authenticity of the items stored in the contents of the packaging apparatus 200. In some industries, counterfeiters are producing knockoff products in packaging the resembles the packaging of the original product. Some manufacturers are marking their products with holographic labels that are difficult to counterfeit to indicate the authenticity of the products within the packaging apparatus 200. In alternative embodiments, the label may be a non-holographic label rather than a holographic label. In another alternative embodiment, the folder/gluer 1000 may not include a label station and assembling 700 the outer sleeve 202 may not include applying 706 a label (not shown) to the precut cartons of the outer sleeve 202.

As shown in FIGS. 11 and 15-17, the label application station 1006 is attached to the conveyor 1002 such that the label application station automatically applies a label to the outer sleeve 202. Specifically, the label application station 1006 includes an application guide 1008 attached to the conveyor 1002 and position the label relative to the conveyor 1002 such that the label application station 1006 automatically receives and applies a label to the outer sleeve 202. The label application station also includes a carton guide 1010 that rapidly presents the outer sleeve 202 for label application. During operation, the outer sleeve 202 is positioned by the carton guide 1010 and the application guide 1008 wipes the label onto the outer sleeve 202.

Next, in the illustrated embodiment, the precut cartons of the outer sleeve 202 are conveyed by the conveyor 1002 to an unfolding/folding station (not shown) and assembling 700 the outer sleeve 202 also includes unfolding/folding 708 the precut cartons of the outer sleeve 202. In the illustrated embodiment, the precut cartons of the outer sleeve 202 are unfolded from the label application orientation into a glue application orientation. In alternative embodiments, the unfolding/folding station (not shown) may fold and unfold the precut cartons of the outer sleeve 202 into any orientation that enables assembling 700 the outer sleeve 202 as described herein.

Next, the precut cartons of the outer sleeve 202 are conveyed by the conveyor 1002 to a glue application station (not shown) and assembling 700 the outer sleeve 202 also includes applying 710 glue to the precut cartons of the outer sleeve 202. In the illustrated embodiment, the glue application station (not shown) includes at least one nozzle (not shown) that applies glue to a portion of the outer sleeve 202. Specifically, in the illustrated embodiment, the glue application station (not shown) includes three nozzles (not shown) that apply glue to the first glue lap 492 of the outer sleeve 202. The three nozzles apply three lines of glue to the first glue lap 492 of the outer sleeve 202. Additionally, the first glue lap 492 of the outer sleeve 202 is wider than typical packaging flaps and the three lines of glue provide additional adhesion between the bottom panel 412 of the outer sleeve 202 and the first glue lap 492 of the outer sleeve 202. Thus, the shape of the first glue lap 492 of the outer sleeve 202 and the additional lines of glue strengthen the outer sleeve 202 and improve the child resistance of the packaging apparatus 200. In alternative embodiments, the glue application station may include any number of nozzles and the nozzles may be configured to apply any number of glue lines that enable assembling 700 the outer sleeve 202 as described herein.

Next, the precut cartons of the outer sleeve 202 are conveyed by the conveyor 1002 to a folding station (not shown) and assembling 700 the outer sleeve 202 also includes folding 712 the precut cartons of the outer sleeve 202. In the illustrated embodiment, the precut cartons of the outer sleeve 202 are folded such that the first glue lap 492 of the outer sleeve 202 and the three glue lines on the first glue lap 492 of the outer sleeve 202 are in contact with the bottom panel 412 of the outer sleeve 202. In alternative embodiments, the folding station (not shown) may fold the precut cartons of the outer sleeve 202 into any orientation that enables assembling 700 the outer sleeve 202 as described herein.

Next, the precut cartons of the outer sleeve 202 are conveyed by the conveyor 1002 to a pressure application station (not shown) and assembling 700 the outer sleeve 202 also includes applying pressure 714 to the precut cartons of the outer sleeve 202. In the illustrated embodiment, the pressure is applied to the precut cartons of the outer sleeve 202 are folded such that the first glue lap 492 of the outer sleeve 202 and the three glue lines 481 on the first glue lap 492 of the outer sleeve 202 are in contact with the bottom panel 412 of the outer sleeve 202. In alternative embodiments, the folding station (not shown) may fold the precut cartons of the outer sleeve 202 into any orientation that enables assembling 700 the outer sleeve 202 as described herein.

Finally, the precut cartons of the outer sleeve 202 are conveyed by the conveyor 1002 to a packaging station (not shown) and assembling 700 the outer sleeve 202 also includes packaging 716 the precut cartons of the outer sleeve 202 into a tray (not shown). In the illustrated embodiment, the precut cartons of the outer sleeve 202 are packaged into the tray and transported to assembling 900 the packaging apparatus 200. In alternative embodiments, the packaging station (not shown) may package the precut cartons of the outer sleeve 202 into any container that enables assembling 700 the outer sleeve 202 as described herein.

Figure 12:
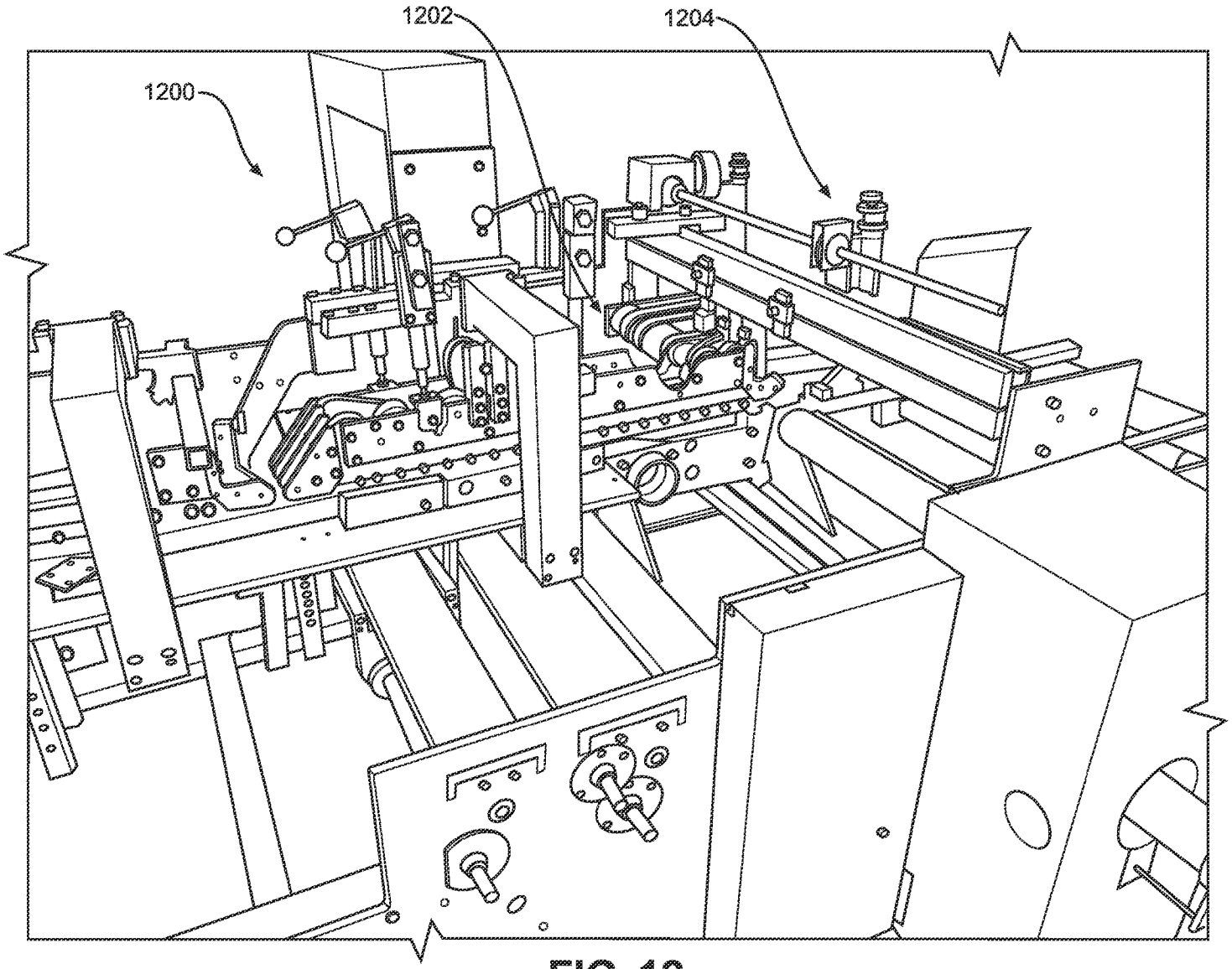
FIG. 12 illustrates an example folder/gluer used to manufacture the packaging apparatus illustrated in FIGS. 2-6.

Referring to FIG. 8, assembling 800 the inner sleeve 204 includes assembling the inner sleeve 204 using a folder/gluer 1200 illustrated in FIG. 12 similar to the folder/gluer 1000 illustrated in FIGS. 10-11. The folder/gluer 1200 includes a conveyor 1202 that conveys the inner sleeve 204 to a plurality of stations 1204 that perform a series of operations that assemble the inner sleeve 204 from the precut cartons of the inner sleeve 204. First, assembling 800 the inner sleeve 204 includes receiving 802 the precut cartons of the inner sleeve 204. Receiving 802 the precut cartons of the inner sleeve 204 may include manually stacking the precut cartons of the inner sleeve 204 in a receiving station (not shown) of the folder/gluer 1200 or may include automatically receiving the precut cartons of the inner sleeve 204 into the receiving station (not shown) of the folder/gluer 1200 from the producing and receiving 104 process. Furthermore, receiving 802 the precut cartons of the inner sleeve 204 may include any receiving process that enables assembling 800 the inner sleeve 204.

Next, the precut cartons of the inner sleeve 204 are conveyed by the conveyor 1202 to a prebreak station (not shown) and assembling 800 the inner sleeve 204 also includes prebreaking 804 the precut cartons of the inner sleeve 204. The precut cartons of the inner sleeve 204 may include a plurality of scores, cuts, and/or prefolds that enable the precut cartons of the inner sleeve 204 to be folded along predetermined lines such that the precut cartons of the inner sleeve 204 may be folded and glued into a predetermined shape illustrated in FIGS. 2-6. However, the scores, cuts, and/or prefolds may not enable downstream stations to properly fold the precut cartons of the inner sleeve 204 because the scores, cuts, and/or prefolds may be too stiff. The prebreak station (not shown) prefolds the precut cartons of the inner sleeve 204 prior to conveying the precut cartons of the inner sleeve 204 to downstream stations to ensure downstream stations can properly fold the precut cartons of the inner sleeve 204 into the predetermined shape illustrated in FIGS. 2-6. Additionally, in the illustrated embodiment, the prebreak station configures the precut cartons of the inner sleeve 204 in an orientation to receive a label thereon.

Next, optionally, the precut cartons of the inner sleeve 204 may be conveyed by the conveyor 1202 to a label application station (not shown) and assembling 800 the inner sleeve 204 may also include applying 806 a label (not shown) to the precut cartons of the inner sleeve 204. In the illustrated embodiment, the label may be a holographic label that indicates the authenticity of the items stored in the contents of the packaging apparatus 200. In some industries, counterfeiters are producing knockoff products in packaging the resembles the packaging of the original product. Some manufacturers are marking their products with holographic labels that are difficult to counterfeit to indicate the authenticity of the products within the packaging apparatus 200. In alternative embodiments, the label may be a non-holographic label rather than a holographic label. The folder/gluer 1200 may not include a label station and assembling 800 the inner sleeve 204 may not include applying 806 a label (not shown) to the precut cartons of the inner sleeve 204.

If the label application station is included in the folder/gluer 1200, the label application station is attached to the conveyor 1202 such that the label application station automatically applies a label to the inner sleeve 204. Specifically, the label application station may include a plurality of brackets (not shown) that attach the label application station to the conveyor 1202 and position the label application station relative to the conveyor 1202 such that the label application station automatically receives and applies a label to the inner sleeve 204. The label application station may also include a plurality of plates (not shown) that rapidly present the inner sleeve 204 for label application.

Next, in the illustrated embodiment, the precut cartons of the inner sleeve 204 are conveyed by the conveyor 1202 to an unfolding/folding station (not shown) and assembling 800 the inner sleeve 204 also includes unfolding/folding 808 the precut cartons of the inner sleeve 204. In the illustrated embodiment, the precut cartons of the inner sleeve 204 are unfolded from the label application orientation into a glue application orientation. In alternative embodiments, the unfolding/folding station (not shown) may fold and unfold the precut cartons of the inner sleeve 204 into any orientation that enables assembling 800 the inner sleeve 204 as described herein.

Next, the precut cartons of the inner sleeve 204 are conveyed by the conveyor 1202 to a glue application station (not shown) and assembling 800 the inner sleeve 204 also includes applying 810 glue to the precut cartons of the inner sleeve 204. In the illustrated embodiment, the glue application station (not shown) includes at least one nozzle (not shown) that applies glue to a portion of the inner sleeve 204.

Next, the precut cartons of the inner sleeve 204 are conveyed by the conveyor 1202 to a folding station (not shown) and assembling 800 the inner sleeve 204 also includes folding 812 the precut cartons of the inner sleeve 204 into the assembled inner sleeve 204 illustrated in FIGS. 2-6. In alternative embodiments, the folding station (not shown) may fold the precut cartons of the inner sleeve 204 into any orientation that enables assembling 800 the inner sleeve 204 as described herein. Specifically, the locking tab 216 on the inner sleeve 204 is folded into the orientation illustrated in FIGS. 2-6 such that the locking tab 216 on the inner sleeve 204 springs into an area (shown in greater detail in FIG. 6) in the outer sleeve 202 adjacent the interior surface of a bottom panel 212 of the outer sleeve 202 due to its memory properties as described above.

Next, the precut cartons of the inner sleeve 204 are conveyed by the conveyor 1202 to a pressure application station (not shown) and assembling 800 the inner sleeve 204 also includes applying pressure 814 to the precut cartons of the inner sleeve 204 to enable the applied glue to set.

Finally, the precut cartons of the inner sleeve 204 are conveyed by the conveyor 1202 to a packaging station (not shown) and assembling 800 the inner sleeve 204 also includes packaging 816 the precut cartons of the inner sleeve 204 into a tray (not shown). In the illustrated embodiment, the precut cartons of the inner sleeve 204 are packaged into the tray and transported to assembling 900 the packaging apparatus 200. In alternative embodiments, the packaging station (not shown) may package the precut cartons of the inner sleeve 204 into any container that enables assembling 800 the inner sleeve 204 as described herein.

Referring to FIG. 9, assembling and packing 900 the packaging apparatus 200 includes finishing 902 the outer sleeve 202, finishing 904 the inner sleeve 204, transferring 906 the inner sleeves 204 to the outer sleeves 202, inserting 908 the inner sleeves 204 into the outer sleeves 202, and assembling 910 the tray for shipment. In the illustrated embodiment, finishing 902 the outer sleeve 202 includes forming the precut cartons of the outer sleeve 202 into the outer sleeve shape illustrated in FIGS. 2-6 and finishing 904 the inner sleeve 204 includes forming the precut cartons of the inner sleeve 204 into the outer sleeve shape illustrated in FIGS. 2-6. The inner sleeves 204 for then transferred 906 to and inserted 908 into the outer sleeves 202 to assemble the packaging apparatus 200. Finally, the tray is assembled 910 and sent to the manufacturer for final packaging.

Figure 13:
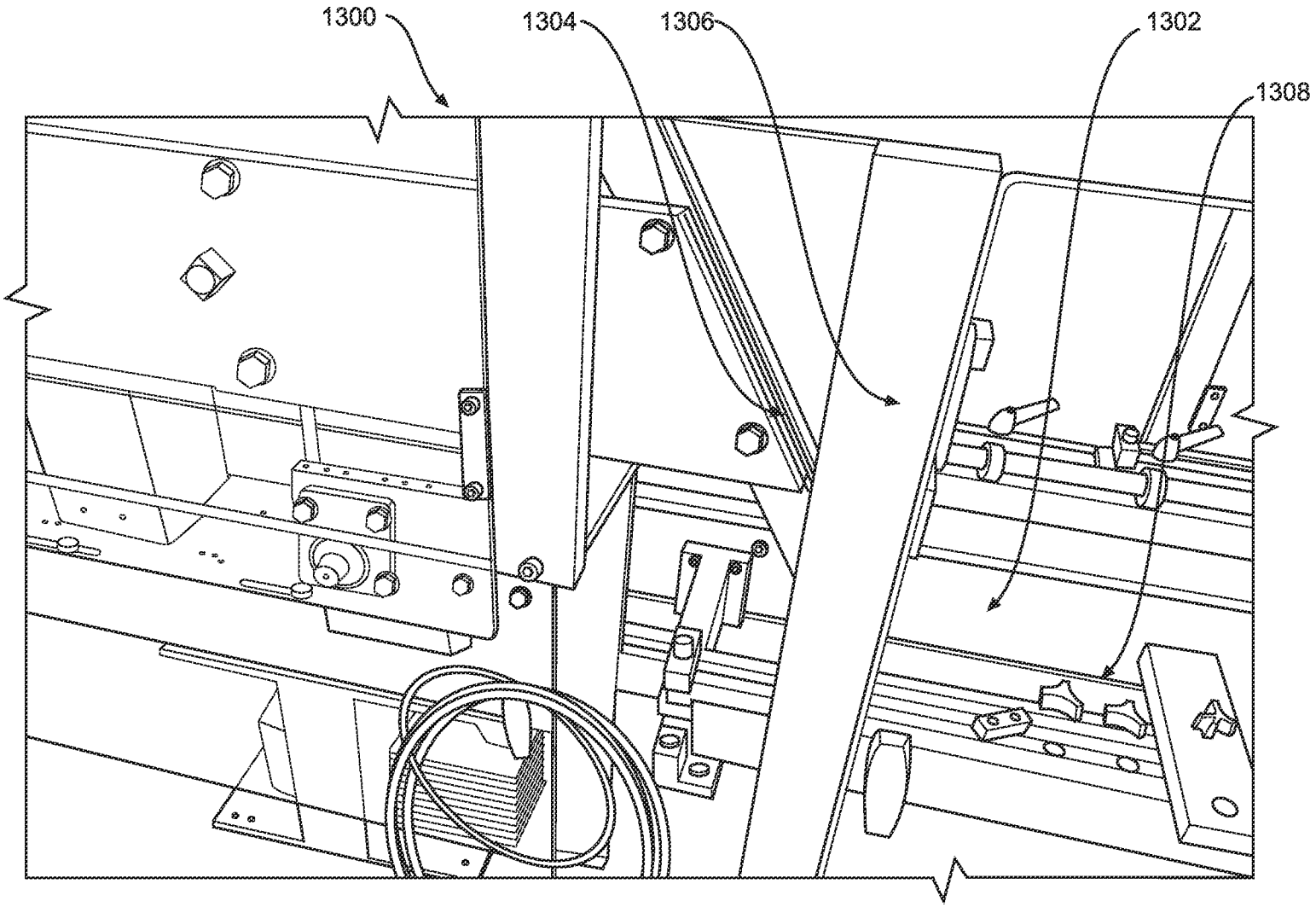
FIG. 13 illustrates an example cartoner used to manufacture the packaging apparatus illustrated in FIGS. 2-6.

Finishing 902 the outer sleeve 202 includes finishing the outer sleeve 202 using a cartoner 1300 illustrated in FIG. 13. The cartoner 1300 includes a chain 1302 that conveys the outer sleeve 202 to a plurality of stations 1304 that perform a series of operations that finish the outer sleeve 202. First, finishing 902 the outer sleeve 202 includes receiving 912 the outer sleeve 202. Receiving 912 the outer sleeve 202 may include manually stacking the outer sleeve 202 in a receiving station (not shown) of the cartoner 1300 or may include automatically receiving the outer sleeve 202 into the receiving station (not shown) of the cartoner 1300 from the packaging 716 process. Furthermore, receiving 912 the outer sleeve 202 may include any receiving process that enables finishing 902 the outer sleeve 202.

Next, the outer sleeves 202 are conveyed by the chain 1302 to a squaring/prebreak station 1306 and finishing 902 the outer sleeve 202 also includes squaring/prebreaking 914 the outer sleeve 202. The outer sleeve 202 may include a plurality of scores, cuts, and/or prefolds that enable the outer sleeve 202 to be folded along predetermined lines such that the outer sleeve 202 may be folded and glued into a predetermined shape illustrated in FIGS. 2-6. However, the scores, cuts, and/or prefolds may not enable downstream stations to properly fold the outer sleeve 202 because the scores, cuts, and/or prefolds may be too stiff. The squaring/prebreak station 1306 prefolds the outer sleeve 202 prior to conveying the outer sleeve 202 to downstream stations to ensure downstream stations can properly fold the outer sleeve 202 into the predetermined shape illustrated in FIGS.

2-6. Additionally, in the illustrated embodiment, the chain 1302 includes a plurality of squaring lugs 1308 that square the outer sleeve 202 and maintain the outer sleeve 202 at an angle (not shown) such that the outer sleeve 202 maintains the shape shown in FIGS. 2-6 throughout the finishing 902 process. In the illustrated embodiment, the angle is about 80° to about 100° or about 90°. In alternative embodiments, the angle may be any angle that enables the cartoner 1300 to operate as described herein. In the illustrated embodiment, the squaring lugs 1308 are formed of plastic, are attached to the chain 1302, and have a triangular shape that squares the outer sleeves 202. In alternative embodiments, the squaring lugs 1308 may be formed of any material and may have any shape that enables the cartoner 1300 to operate as described herein.

Next, optionally, the outer sleeve 202 may be conveyed by the chain 1302 to a label application station (not shown) and finishing 902 the outer sleeve 202 may also include applying, printing, and/or engraving 916 a label (not shown) to the outer sleeve 202. In the illustrated embodiment, the label may be a holographic label that indicates the authenticity of the items stored in the contents of the packaging apparatus 200. In some industries, counterfeiters are producing knock-off products in packaging the resembles the packaging of the original product. Some manufacturers are marking their products with holographic labels that are difficult to counterfeit to indicate the authenticity of the products within the packaging apparatus 200. In alternative embodiments, the label may be a non-holographic label rather than a holographic label. The cartoner 1300 may not include a label station and finishing 902 the outer sleeve 202 may not include applying 916 a label (not shown) to the outer sleeve 202. Additionally, in another alternative embodiment, the label may be printed or engraved on the outer sleeve 202.

If the label application station is included in the cartoner 1300, the label application station is attached to the chain 1302 such that the label application station automatically applies a label to the outer sleeve 202. Specifically, the label application station may include a plurality of brackets (not shown) that attach the label application station to the chain 1302 and position the label application station relative to the chain 1302 such that the label application station automatically receives and applies a label to the outer sleeve 202. The label application station may also include a plurality of plates (not shown) that rapidly present the outer sleeve 202 for label application.

Next, in the illustrated embodiment, the outer sleeves 202 are conveyed by the chain 1302 to an unfolding/folding station (not shown) and finishing 902 the outer sleeve 202 also includes unfolding/folding 918 the outer sleeve 202. In the illustrated embodiment, the outer sleeve 202 is unfolded from the label application orientation into a glue application orientation. In alternative embodiments, the unfolding/folding station (not shown) may fold and unfold the outer sleeve 202 into any orientation that enables finishing 902 the outer sleeve 202 as described herein.

Next, the outer sleeves 202 are conveyed by the chain 1302 to a glue application station (not shown) and finishing 902 the outer sleeve 202 also includes applying 920 glue to the outer sleeve 202. In the illustrated embodiment, the glue application station (not shown) includes at least one nozzle (not shown) that applies glue to a portion of the outer sleeve 202.

Next, the outer sleeves 202 are conveyed by the chain 1302 to a folding station (not shown) and finishing 902 the outer sleeve 202 also includes folding 922 the outer sleeve 202 into the assembled outer sleeve 202 illustrated in FIGS. 2-6. In alternative embodiments, the folding station (not shown) may fold the outer sleeve 202 into any orientation that enables finishing 902 the outer sleeve 202 as described herein.

Finally, the outer sleeves 202 are conveyed by the chain 1302 to a packaging station (not shown) and finishing 902 the outer sleeve 202 also includes packaging 924 the outer sleeve 202 into a tray (not shown). In the illustrated embodiment, the outer sleeves 202 are packaged into the tray and transported to inserting 908 the inner sleeves 204 into the outer sleeves 202. In alternative embodiments, the packaging station (not shown) may package the outer sleeve 202 into any container that enables finishing 902 the outer sleeve 202 as described herein.

Figure 14:
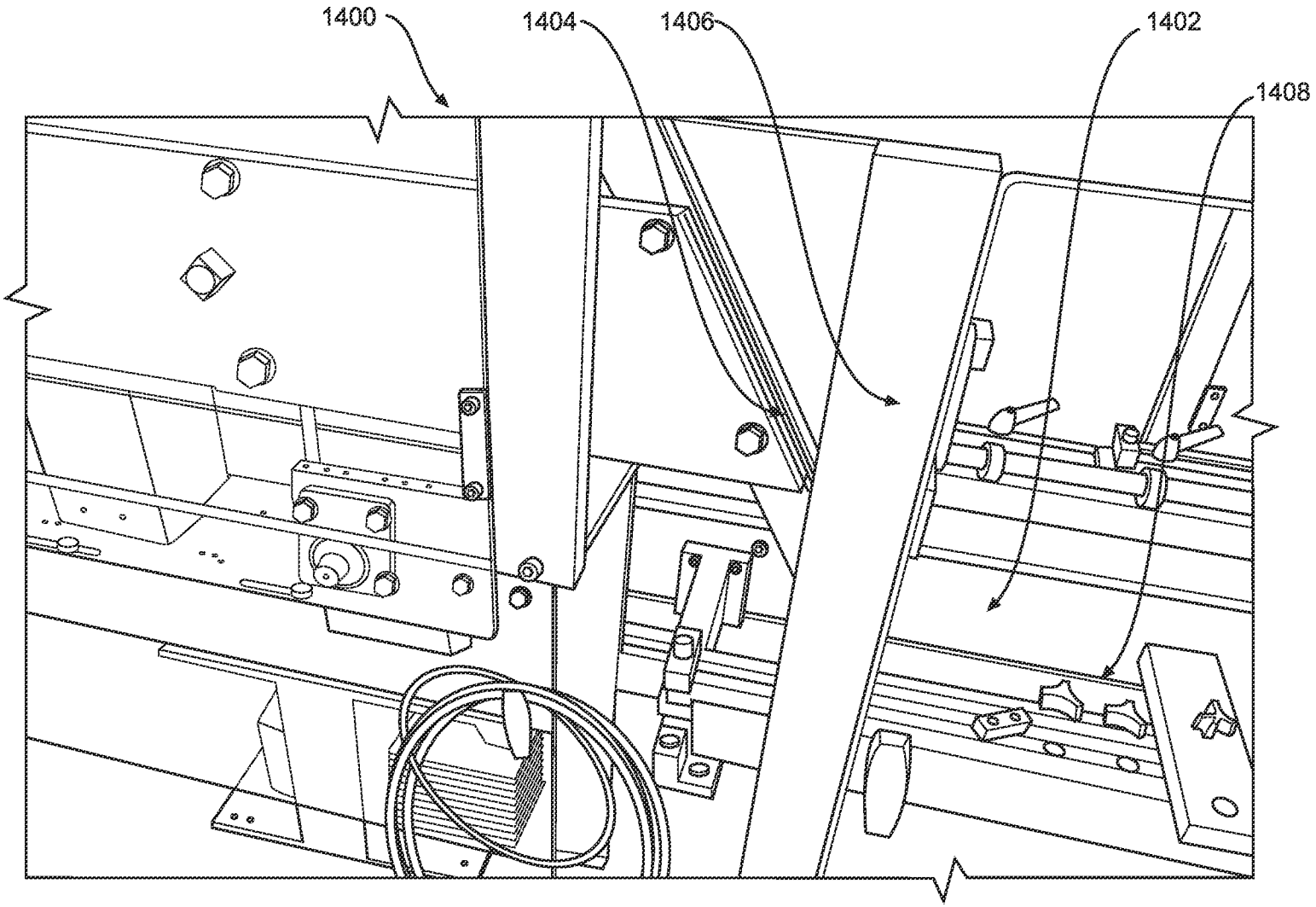
FIG. 14 illustrates an example cartoner used to manufacture the packaging apparatus illustrated in FIGS. 2-6.
Figure 15:
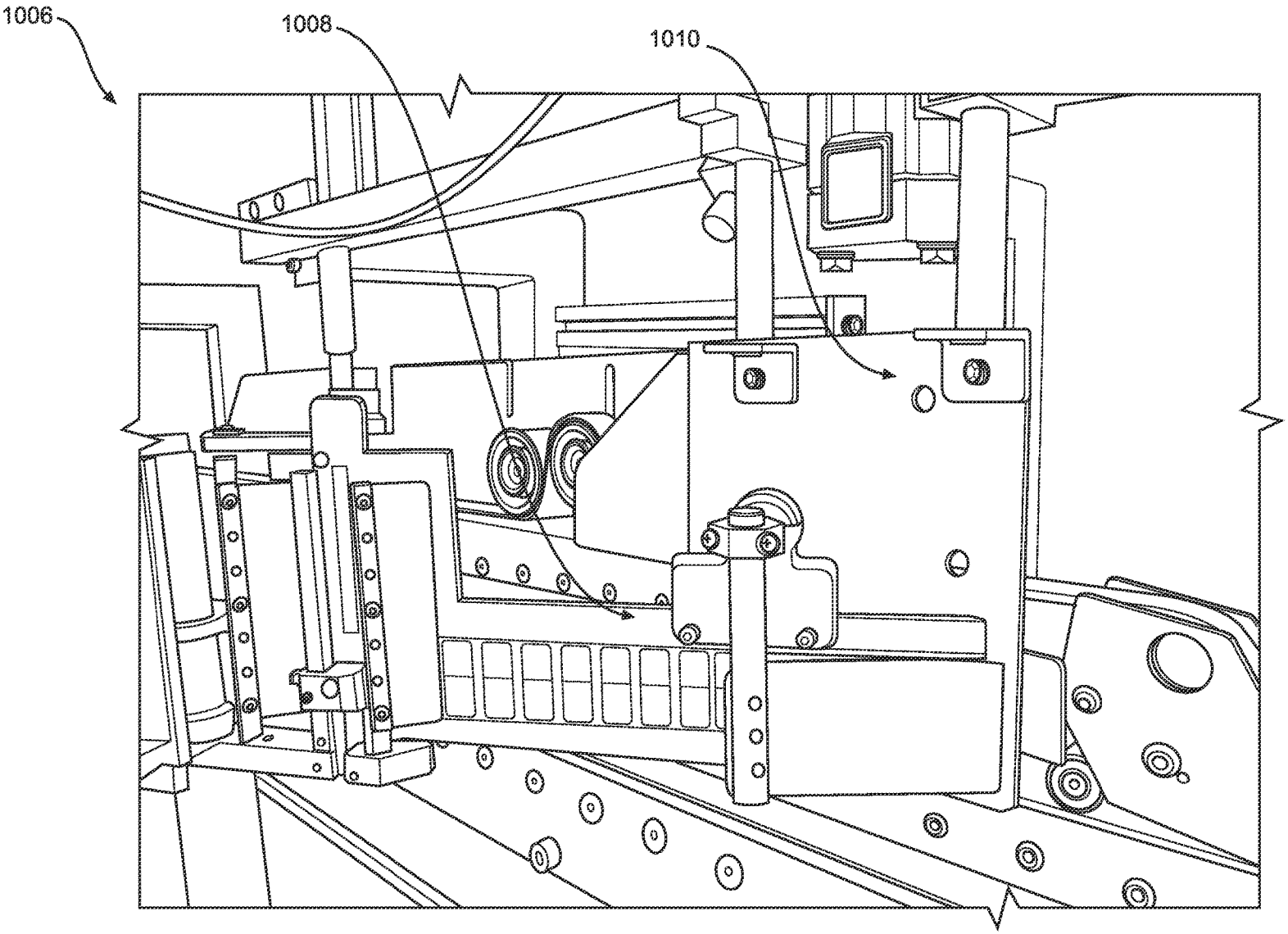
FIG. 15 illustrates an example labeling station of the folder/gluer illustrated in FIGS. 10-12.
Figure 16:
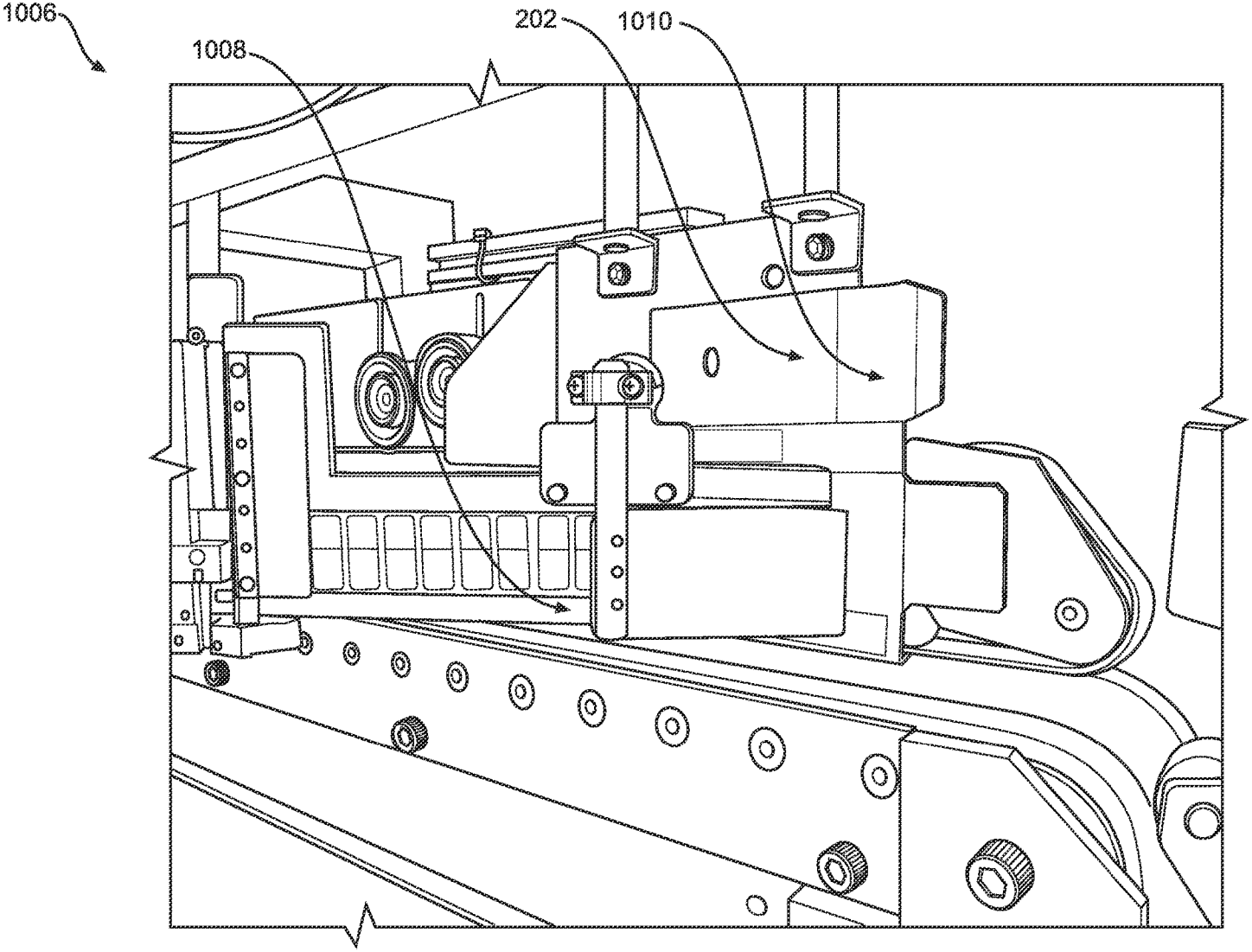
FIG. 16 illustrates the labeling station of the folder/gluer illustrated in FIG. 15.
Figure 17:
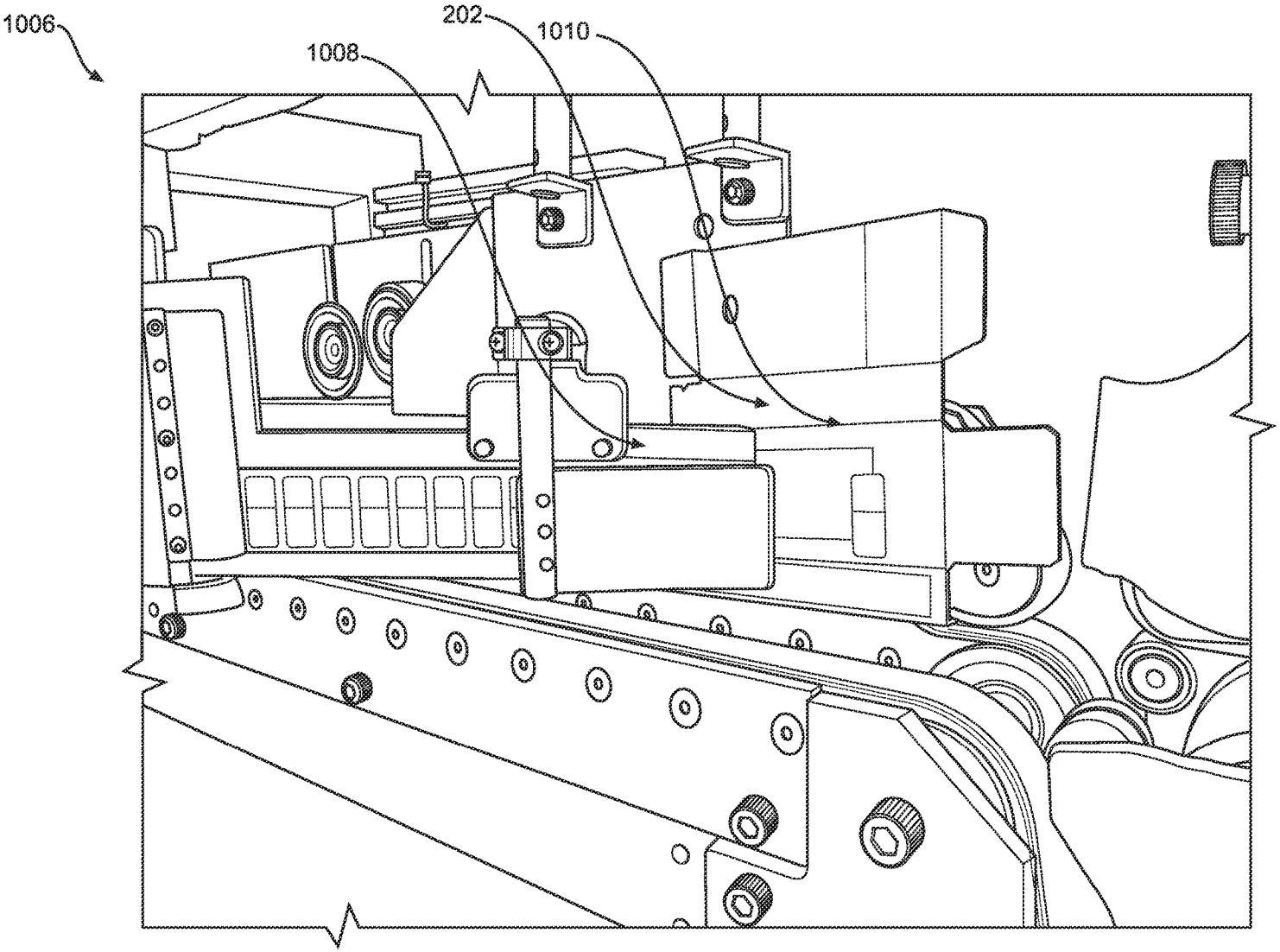
FIG. 17 illustrates the labeling station of the folder/gluer illustrated in FIG. 15.

Finishing 904 the inner sleeve 204 includes finishing the inner sleeve 204 using a cartoner 1400 illustrated in FIG. 14. The cartoner 1400 includes a chain 1402 that conveys the inner sleeve 204 to a plurality of stations 2104 that perform a series of operations that finish the inner sleeve 204. First, finishing 904 the inner sleeve 204 includes receiving 926 the inner sleeve 204. Receiving 926 the inner sleeve 204 may include manually stacking the inner sleeve 204 in a receiving station (not shown) of the cartoner 1400 or may include automatically receiving the inner sleeve 204 into the receiving station (not shown) of the cartoner 1400 from the packaging 816 process. Furthermore, receiving 926 the inner sleeve 204 may include any receiving process that enables finishing 904 the inner sleeve 204.

Next, the outer sleeves 202 are conveyed by the chain 1402 to a squaring/prebreak station 1406 and finishing 904 the inner sleeve 204 also includes squaring/prebreaking 928 the inner sleeve 204. The inner sleeve 204 may include a plurality of scores, cuts, and/or prefolds that enable the inner sleeve 204 to be folded along predetermined lines such that the inner sleeve 204 may be folded and glued into a predetermined shape illustrated in FIGS. 2-6. However, the scores, cuts, and/or prefolds may not enable downstream stations to properly fold the inner sleeve 204 because the scores, cuts, and/or prefolds may be too stiff. The squaring/prebreak station 1406 prefolds the inner sleeve 204 prior to conveying the inner sleeve 204 to downstream stations to ensure downstream stations can properly fold the inner sleeve 204 into the predetermined shape illustrated in FIGS. 2-6. Additionally, in the illustrated embodiment, the chain 1402 includes a plurality of squaring lugs 1408 that square the inner sleeve 204 and maintain the inner sleeve 204 at an angle (not shown) such that the inner sleeve 204 maintains the shape shown in FIGS. 2-6 throughout the finishing 902 process. In the illustrated embodiment, the angle is about 80° to about 100° or about 90°. In alternative embodiments, the angle may be any angle that enables the cartoner 1400 to operate as described herein. In the illustrated embodiment, the squaring lugs 1408 are formed of plastic, are attached to the chain 1402, and have a triangular shape that squares the outer sleeves 202. In alternative embodiments, the squaring lugs 1408 may be formed of any material and may have any shape that enables the cartoner 1400 to operate as described herein.

Next, optionally, the inner sleeve 204 may be conveyed by the chain 1402 to a label application station (not shown) and finishing 904 the inner sleeve 204 may also include applying, printing, and/or engraving 930 a label (not shown) to the inner sleeve 204. In the illustrated embodiment, the label may be a holographic label that indicates the authenticity of the items stored in the contents of the packaging apparatus 200. In some industries, counterfeiters are producing knock-off products in packaging the resembles the packaging of the original product. Some manufacturers are marking their products with holographic labels that are difficult to counterfeit to indicate the authenticity of the products within the packaging apparatus 200. In alternative embodiments, the label may be a non-holographic label rather than a holographic label. The cartoner 1400 may not include a label station and finishing 904 the inner sleeve 204 may not include applying 930 a label (not shown) to the inner sleeve 204. Additionally, in another alternative embodiment, the label may be printed or engraved on the inner sleeve 204.

If the label application station is included in the cartoner 1400, the label application station is attached to the chain 1402 such that the label application station automatically applies a label to the inner sleeve 204. Specifically, the label application station may include a plurality of brackets (not shown) that attach the label application station to the chain 1402 and position the label application station relative to the chain 1402 such that the label application station automatically receives and applies a label to the inner sleeve 204. The label application station may also include a plurality of plates (not shown) that rapidly present the inner sleeve 204 for label application.

Next, in the illustrated embodiment, the outer sleeves 202 are conveyed by the chain 1402 to an unfolding/folding station (not shown) and finishing 904 the inner sleeve 204 also includes unfolding/folding 932 the inner sleeve 204. In the illustrated embodiment, the inner sleeve 204 is unfolded from the label application orientation into a glue application orientation. In alternative embodiments, the unfolding/folding station (not shown) may fold and unfold the inner sleeve 204 into any orientation that enables finishing 904 the inner sleeve 204 as described herein.

Next, the outer sleeves 202 are conveyed by the chain 1402 to a glue application station (not shown) and finishing 904 the inner sleeve 204 also includes applying 934 glue to the inner sleeve 204. In the illustrated embodiment, the glue application station (not shown) includes at least one nozzle (not shown) that applies glue to a portion of the inner sleeve 204.

Next, the outer sleeves 202 are conveyed by the chain 1402 to a folding station (not shown) and finishing 904 the inner sleeve 204 also includes folding 936 the inner sleeve 204 into the assembled inner sleeve 204 illustrated in FIGS. 2-6. In alternative embodiments, the folding station (not shown) may fold the inner sleeve 204 into any orientation that enables finishing 904 the inner sleeve 204 as described herein.

Finally, the outer sleeves 202 are conveyed by the chain 1402 to a packaging station (not shown) and finishing 904 the inner sleeve 204 also includes packaging 938 the inner sleeve 204 into a tray (not shown). In the illustrated embodiment, the outer sleeves 202 are packaged into the tray and transported to inserting 908 the inner sleeves 204 into the outer sleeves 202. In alternative embodiments, the packaging station (not shown) may package the inner sleeve 204 into any container that enables finishing 904 the inner sleeve 204 as described herein.

In the illustrated embodiment, transferring 906 the inner sleeves 204 to the outer sleeves 202 includes transferring the tray that includes the inner sleeves 204 to the outer sleeves 202. In alternative embodiments, the inner sleeves 204 may be transferred to the outer sleeves 202 in any manner that enables method 100 to operate as described herein.

In the illustrated embodiment, inserting 908 the inner sleeves 204 into the outer sleeves 202 include manually inserting the inner sleeves 204 into the outer sleeves 202. Specifically, in the illustrated embodiment, the outer sleeves 202 remain in the tray and the inner sleeves 204 are individually transferred from the tray and individually inserted into the outer sleeves 204. In alternative embodiments, the inner sleeves 202 may be inserted into the outer sleeves 202 in any manner that enables method 100 to operate as described herein. For example, method 100 may include an automation system (not shown) including a robotic arm and the robotic arm may automatically insert the inner sleeves 204 into the outer sleeves 202.

In the illustrated embodiment, assembling 910 the tray for shipment includes placing a lid on the tray. In alternative embodiments, tray may be assembled in any manner that enables method 100 to operate as described herein.

The method 100 (including assembling 700 the outer sleeve 202 (shown in FIG. 7), assembling 800 the inner sleeve 204 (shown in FIG. 8), and assembling and packing 900 the packaging apparatus 200 (shown in FIG. 9)) may be automated using robotic equipment to automate manual tasks. For example, the steps of transferring 906 the inner sleeves 204 to the outer sleeves 202, inserting 908 the inner sleeves 204 into the outer sleeves 202, and assembling 910 the tray for shipment may be automated using robotic equipment. More specifically, the equipment described herein may include additional robotic equipment (such as, but not limited to, robotic arms) that is programmed to accomplish the steps of transferring 906 the inner sleeves 204 to the outer sleeves 202, inserting 908 the inner sleeves 204 into the outer sleeves 202, and assembling 910 the tray for shipment may be automated using robotic equipment. Additionally, other steps within method 100 may also be automated.

The method 100 described herein manufactures the packaging apparatus 200 that is child resistant such that a child will not be able to access the contents of the packaging apparatus 200. More specifically, the packaging apparatus 200 has an outer sleeve 202, an inner sleeve 204, and a locking mechanism. The locking mechanism is formed by applying additional glue in predetermined locations and adding additional folds to increase the strength of the packaging apparatus 200 and forms the locking mechanism that is child resistant. If a child, for example, tries to get into the packaging apparatus 200 and forcefully grabs or pulls the packaging apparatus 200, the locking mechanism is configured to prevent the child from accessing the packaging apparatus 200 and the additional glue and folds resist tearing. Accordingly, the methods described herein enable the packaging apparatus 200 to be child resistant such that a child will not be able to access the contents of the packaging apparatus 200.

Figure 18A:
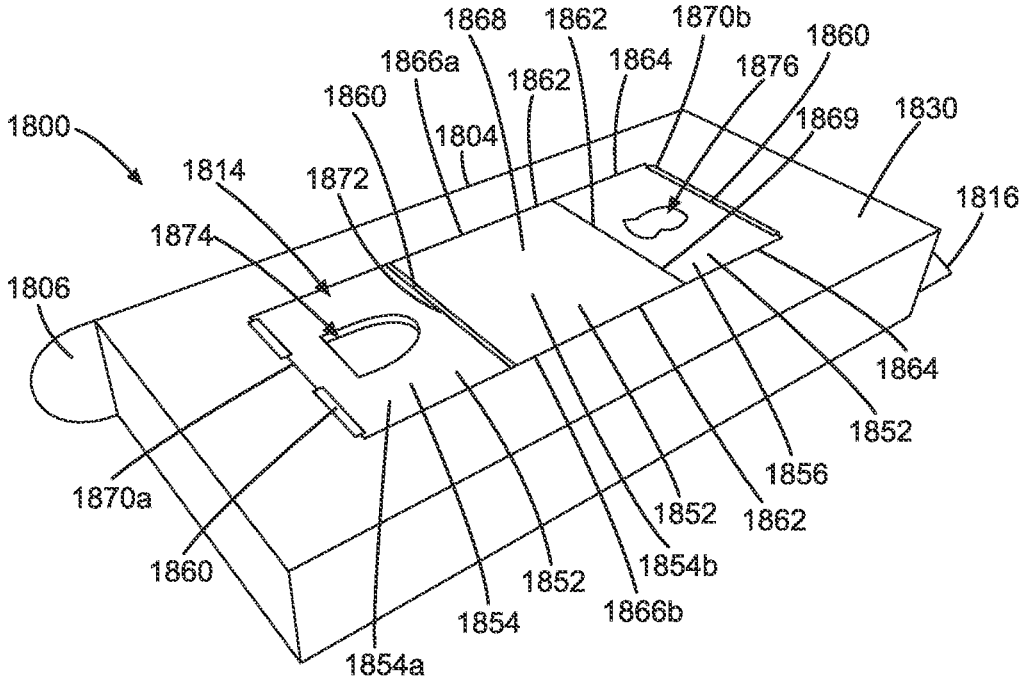
FIG. 18A-E illustrate views of an example packaging apparatus during use.

FIGS. 18A-E illustrate perspective views of an alternative example inner sleeve 1804 that may be used with outer sleeves 202, 302, 402, 502, and 602 of a packaging apparatus 1800 during assembly. FIG. 18A illustrates a perspective view of the inner sleeve 1804 separated from an outer sleeve 202, 302, 402, 502, and 602 before assembly. The inner sleeve 1804 includes a top panel of the inner sleeve 1830, a bottom panel 1832 of the inner sleeve 1804, a locking tab on the inner sleeve 1816 connected to an end of the inner sleeve 1804, and a pull tab 1806 connected to an end of the inner sleeve 1804. The inner sleeve 1804 also has an inner sleeve compartment 1814 shown in the top panel of the inner sleeve 1830 which acts as a storage compartment for holding items 1850 in place and for storing the items 1850 in the outer sleeve 202, 302, 402, 502, and 602. The inner sleeve compartment 1814 can vary in design, size, and shape depending on the design and use of the packaging apparatus 1800, as well as the required design for desired items 1850 to be stored in the outer sleeve 202, 302, 402, 502, and 602. Specifically, as described below, the inner sleeve compartment 1814 is substantially similar to inner sleeves 204, 304, 404, 504, and 604 except the inner sleeve 1804 includes a top panel 1868 including a plurality of storage item panels 1852 that are configurable to hold the item 1850. The top panel 1868 of the inner sleeve compartment 1814 is configured to fold into the inner sleeve compartment 1814 and hold the item 1850.

Figure 18B:
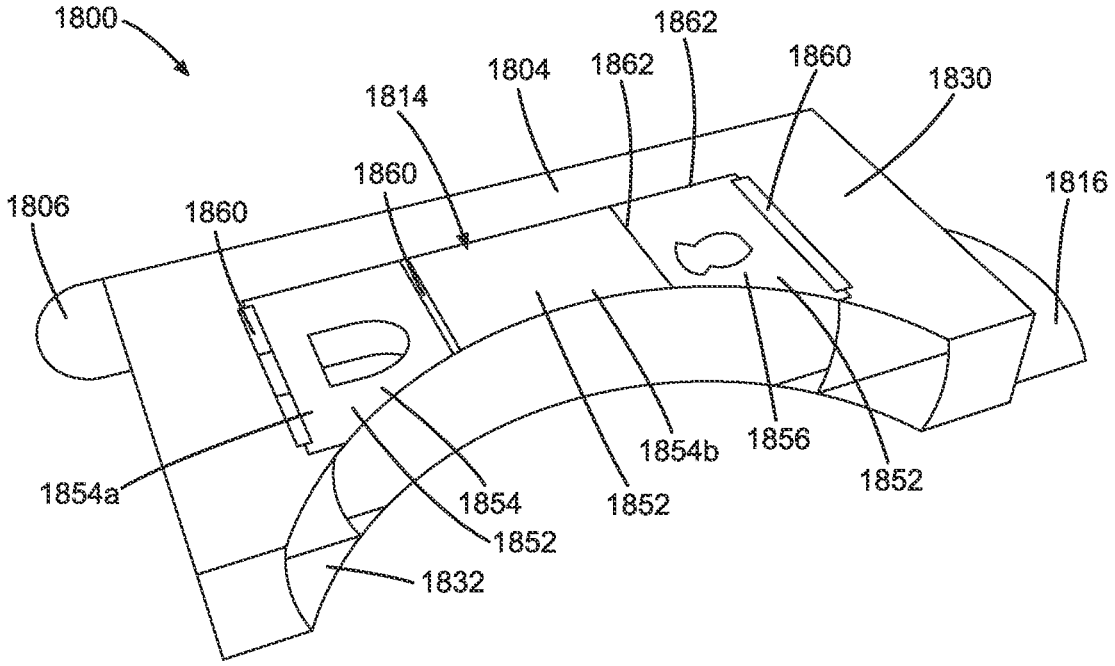
Figure 18C:
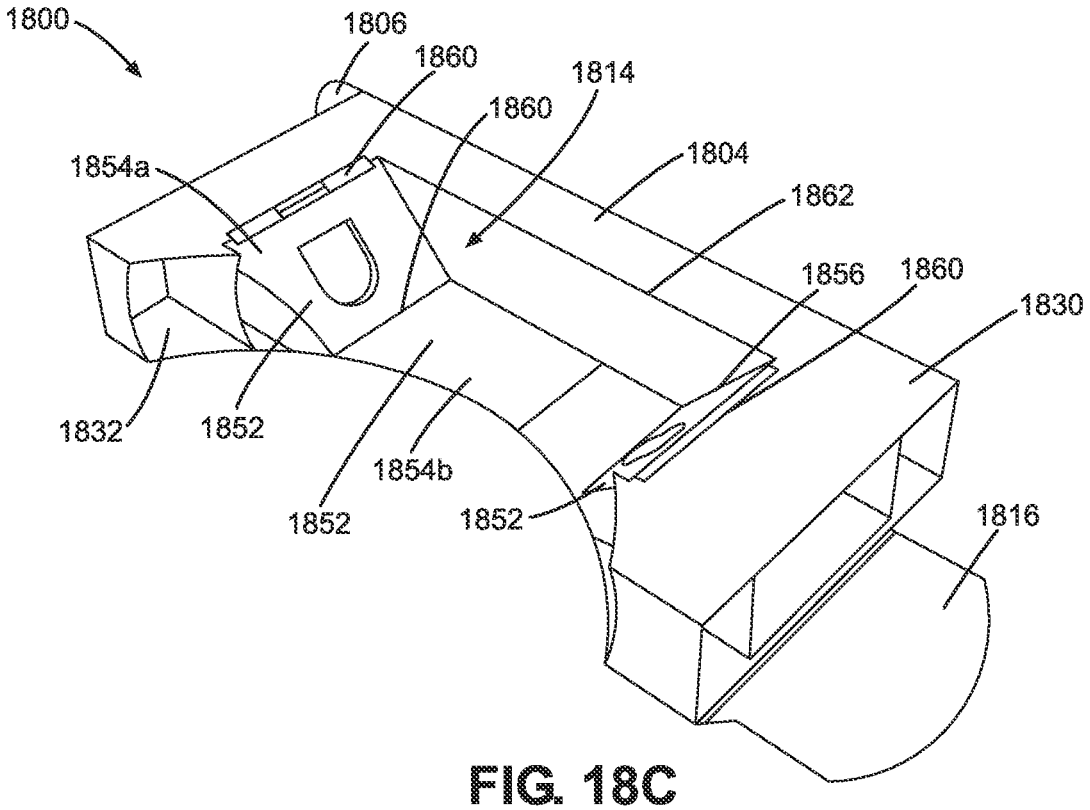
Figure 18D:
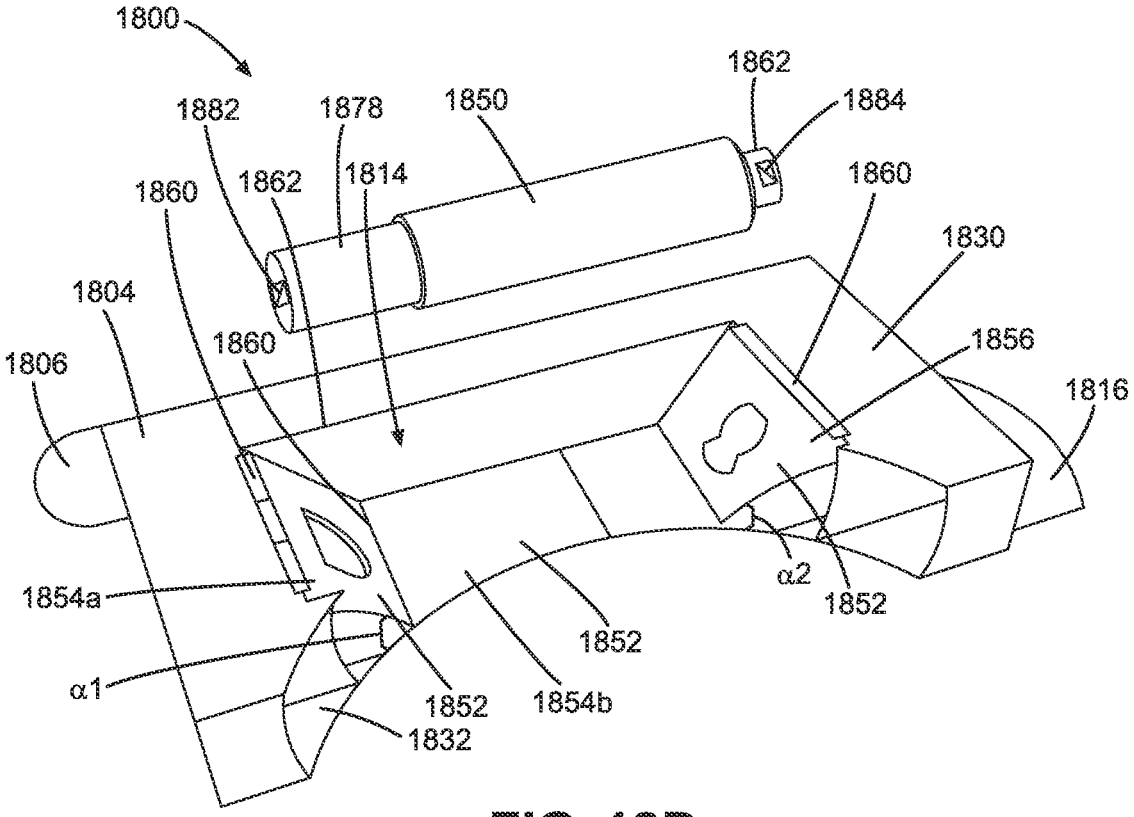
Figure 18E:
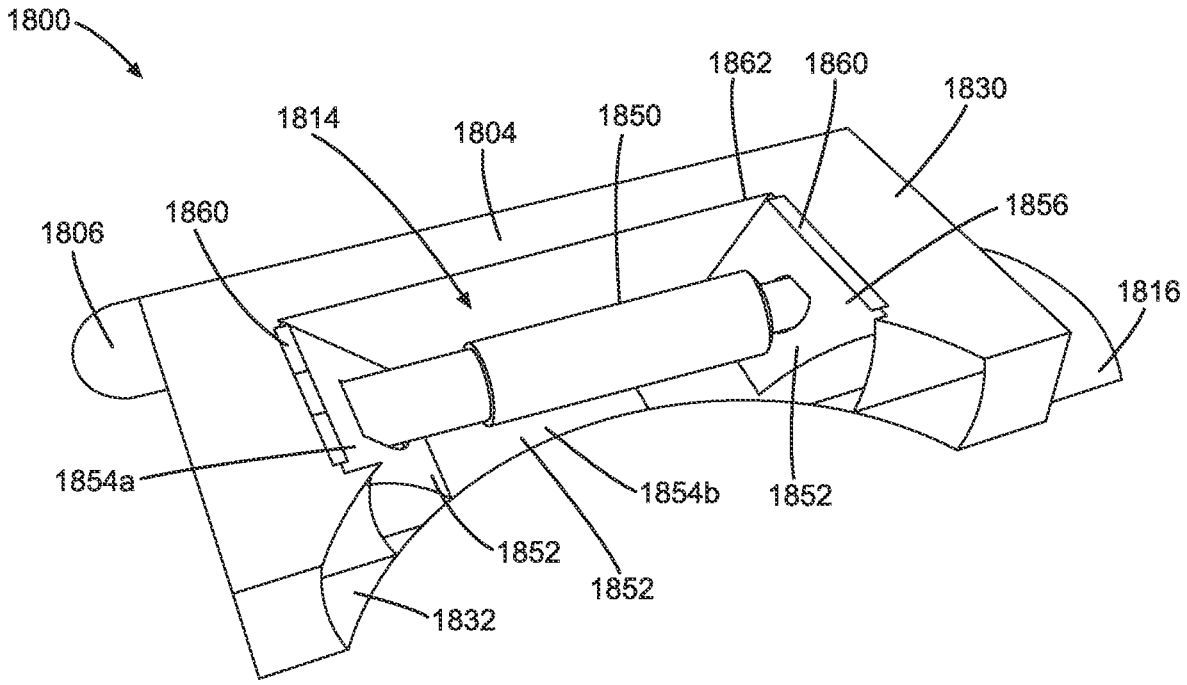

FIG. 18B illustrates a partial cut away view of the inner sleeve 1804 showing the storage item panels 1852 in a stored configuration. FIG. 18C illustrates a partial cut away view of the inner sleeve 1804 showing the storage item panels 1852 in a deployed configuration. FIG. 18D illustrates a partial cut away view of the inner sleeve 1804 showing the storage item panels 1852 in the deployed configuration and the item 1850 being inserted into the inner sleeve compartment 1814. FIG. 18E illustrates a partial cut away view of the inner sleeve 1804 showing the storage item panels 1852 in the deployed configuration and the item 1850 being inserted into the inner sleeve compartment 1814. In the illustrated implementation, the inner sleeve 1804 includes two storage item panels 1852 including a first storage item panel 1854 and a second storage item panel 1856. In other implementations, the inner sleeve 1804 may include any number of storage item panels 1852 that enable the inner sleeve 1804 to operate as described herein including, without limitation, one storage item panel 1852, three storage item panels 1852, four storage item panels 1852, and/or more than four storage item panels 1852. Additionally, each of the first and second storage item panels 1854 and 1856 may include one or more panels separated by one or more creases. In the stored configuration illustrated in FIGS. 18A and 18B, the storage item panels 1852 are positioned such that they are substantially coplanar with each other and with the top panel of the inner sleeve 1830.

The storage item panels 1852 are separated from each other and from the top panel of the inner sleeve 1830 by a plurality of creases 1860 and a plurality of perforated seams 1862. The perforated seams 1862 completely separate a side of the storage item panels 1852 from the top panel of the inner sleeve 1830 and from each other, and the creases 1860 maintain a connection between the storage item panels 1852 and the top panel of the inner sleeve 1830 while enabling the storage item panels 1852 to be pressed down and rotated about the creases 1860. Specifically, the first storage item panel 1854 and the second storage item panel 1856 are separated from the top panel of the inner sleeve 1830 by a first end crease 1870*a* and a second end crease 1870*b*, and the first storage item panel 1854 is separated into a first storage item end panel 1854*a* and a first storage item middle panel 1854*b* by a panel crease 1872. The sides 1864 of the storage item panels 1852 are separated from the top panel of the inner sleeve 1830 by a first side perforated seam 1866*a* and a second side perforated seam 1866*b*. Additionally, the second storage item panel 1856 and the first storage item middle panel 1854*b* are separated by a panel perforated seam 1869 that is configured to break and separate the first storage item panel 1854 and the second storage item panel 1856 from each other when a user presses down on at least one of the first storage item panel 1854 or the second storage item panel 1856.

As shown in FIGS. 18A-E, the first storage item panel end 1854*a* defines a first aperture 1874 and the second storage item panel 1856 defines a second aperture 1876. As shown in FIGS. 18D and 18E, the item 1850 has a cylindrical shape and has a first end 1878 having a first diameter 1880 and a second end 1882 having a second diameter 1884. The first aperture 1874 has a predetermined size that is sized and shaped to receive the first end 1878 into the first aperture 1874 to hold and secure the item 1850 within the inner sleeve compartment 1814, and the second aperture 1876 has a predetermined size that is sized and shaped to receive the second end 1882 into the second aperture 1876 to hold and secure the item 1850 within the inner sleeve compartment 1814. In other implementations, the item 1850 may have a different, non-cylindrical shape, and the first aperture 1874 and the second aperture 1876 may be sized and shaped to receive the item 1850 therein.

In the deployed configuration illustrated in FIGS. 18C-E, the storage item panels 1852 are pressed toward the bottom panel 1832 of the inner sleeve 1804 such that the storage item panels 1852 are positioned to receive and secure the item 1850. For example, the first storage item panel 1854 and the second storage item panel 1856 are pressed toward the bottom panel 1832 of the inner sleeve 1804 such that the second storage item panel 1856 lies approximately adjacent or substantially parallel to an interior surface of the bottom panel of the inner sleeve 1832 and the first storage item end panel 1854*a* is positioned at a first angle $\alpha 1$ relative to the bottom panel of the inner sleeve 1832 such that the first storage item end panel 1854*a* is an end panel of the inner sleeve compartment 1814. Additionally, the second storage item panel 1856 is pressed toward the bottom panel 1832 of the inner sleeve 1804 such that the second storage item panel 1856 is positioned at a second angle $\alpha 2$ relative to the bottom panel of the inner sleeve 1832 such that the second storage item panel 1856 is an end panel of the inner sleeve compartment 1814. The first storage item panel 1854 and the second storage item panel 1856 remain attached to the top panel of the inner sleeve 1830 at the first end crease 1870*a* and the second end crease 1870*b*. Rotating the first storage item end panel 1854*a* about the first end crease 1870*a* and the second storage item panel 1856 about the second end crease 1870*b* forms the first and second angles $\alpha 1$ and $\alpha 2$. Additionally, the second storage item panel 1856 is rotated about the panel crease 1872 and is separated from the first storage item middle panel 1854*b* by the panel perforated seam 1869 such that the first storage item middle panel 1854*b* lies approximately adjacent or substantially parallel to the interior surface of the bottom panel of the inner sleeve 1832. The first and second storage item panels 1854 and 1856 are folded into the inner sleeve compartment 1814 directly adjacent to side walls of the inner sleeve compartment 1814.

As shown in FIGS. 18D and 18E, the item 1850 is positioned within the inner sleeve compartment 1814 after the storage item panels 1852 have been reconfigured in the deployed configuration. Specifically, the first end 1878 of the item 1850 is inserted into the first aperture 1874, and the second end 1882 of the item 1850 is inserted into the second aperture 1876. The first end 1878 of the item 1850 extends beyond the first aperture 1874 and the second end 1882 of the item 1850 extends beyond the second aperture 1876 such that the item 1850 is secured within the inner sleeve compartment 1814 of the inner sleeve 1804. Additionally, the item 1850 is removed from the inner sleeve compartment 1814 of the inner sleeve 1804 by further inserting the first end 1878 of the item 1850 into the first aperture 1874 until the second end 1882 of the item 1850 is extracted from the second aperture 1876 and extracting the first end 1878 of the item 1850 from the first aperture 1874 after the second end 1882 of the item 1850 has been extracted from the second aperture 1876.

Figure 19A:
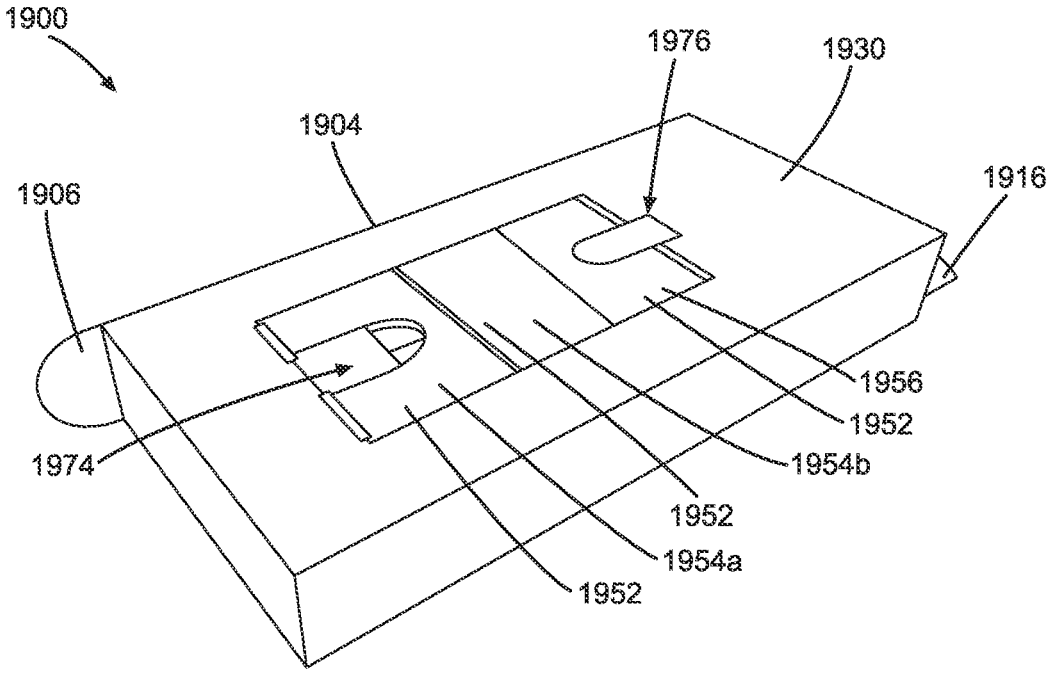
FIG. 19A-E illustrate views of an example packaging apparatus during use.
Figure 19B:
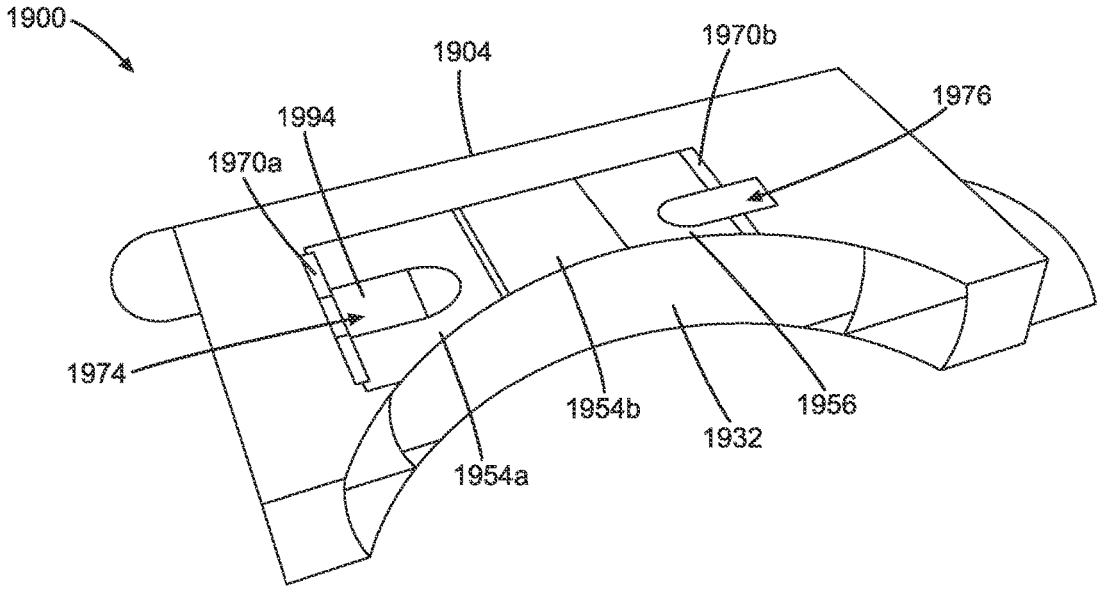
Figure 19C:
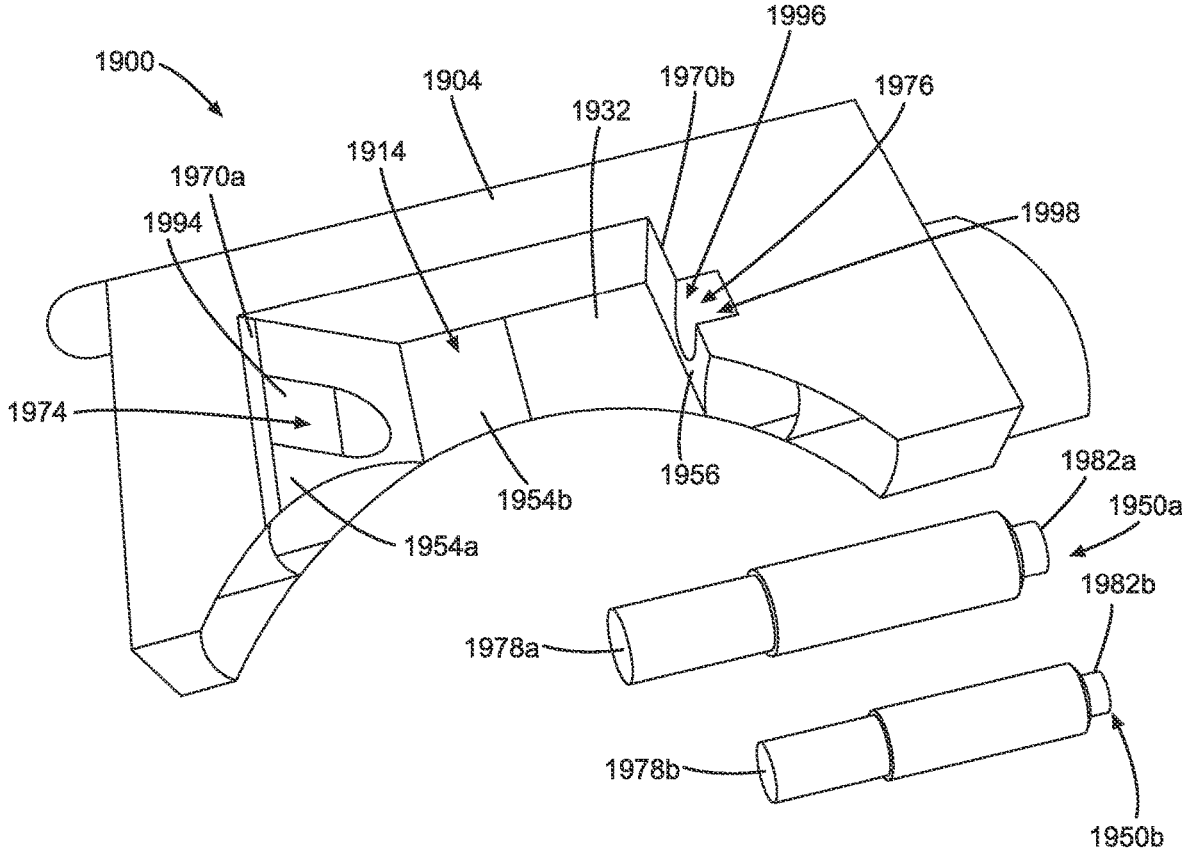
Figure 19D:
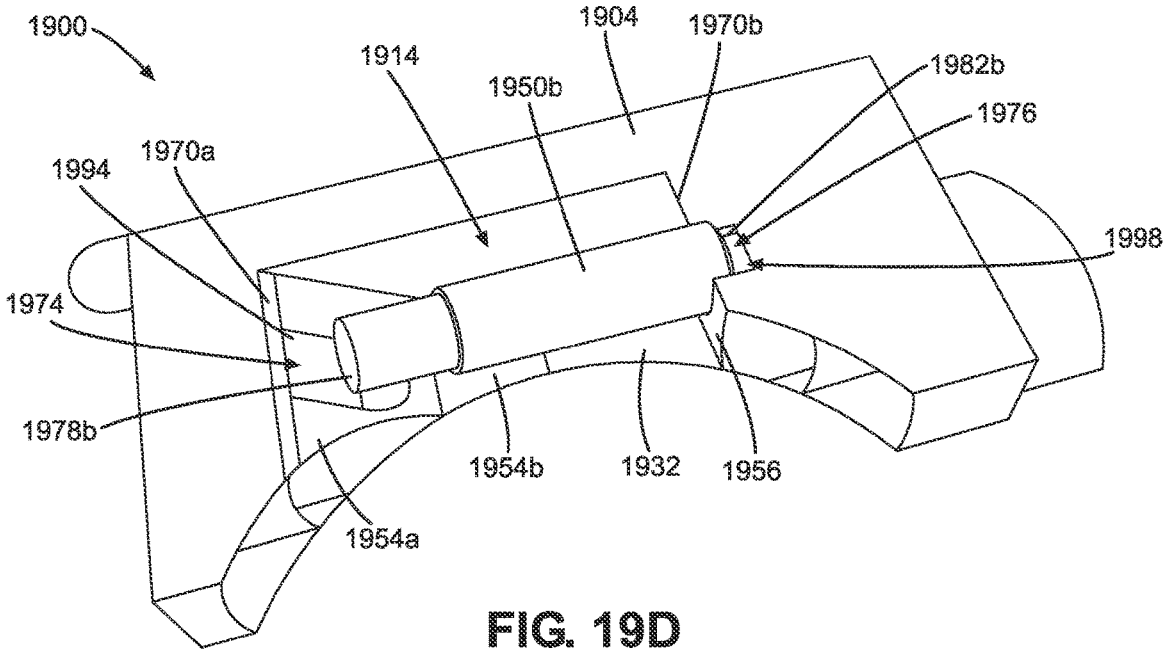
Figure 19E:
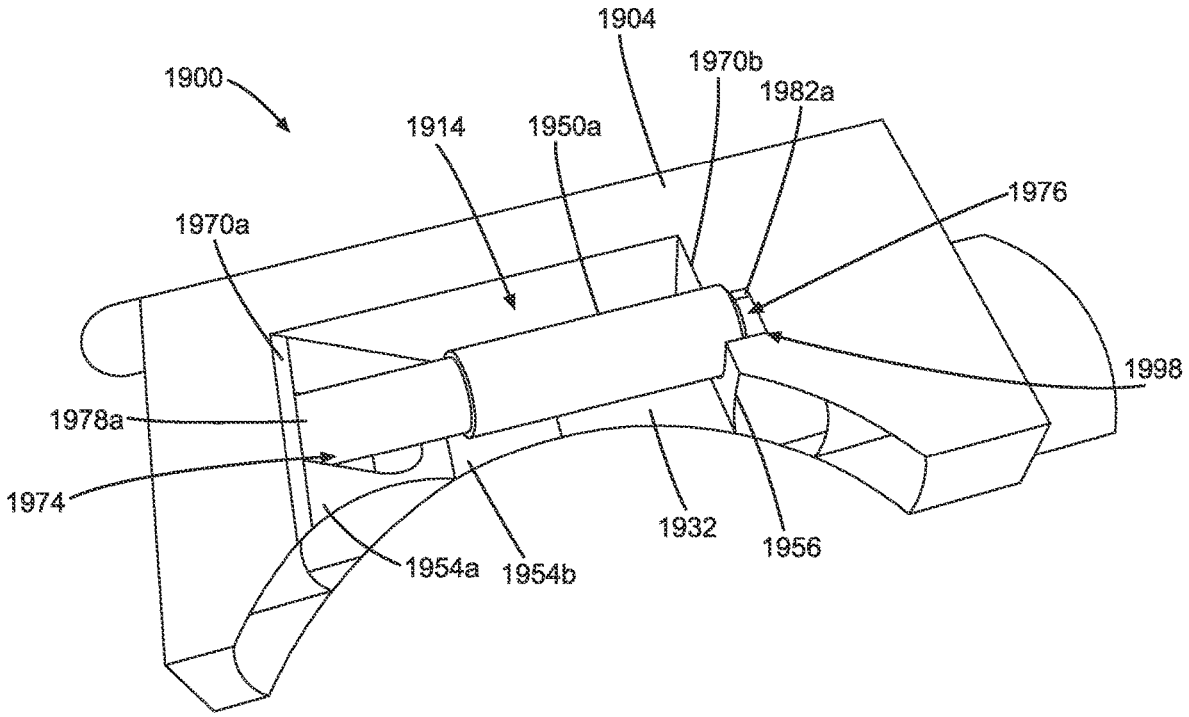

FIGS. 19A-E illustrate perspective views of an example inner sleeve 1904 of a packaging apparatus 1900 during assembly. The inner sleeve 1904 is substantially similar to the inner sleeve 1804 illustrated in FIGS. 18A-E except first and second apertures 1974 and 1976 are configured to receive and secure items 1950 of varying sizes. FIG. 19A illustrates a perspective view of the inner sleeve 1904 separated from an outer sleeve 202, 302, 402, 502, and 602 before assembly. FIG. 19B illustrates a partial cut away view of the inner sleeve 1904 showing a plurality of storage item panels 1952 in a stored configuration. FIG. 19C illustrates a partial cut away view of the inner sleeve 1904 showing the storage item panels 1952 in a deployed configuration. FIG. 19D illustrates a partial cut away view of the inner sleeve 1904 showing the storage item panels 1952 in the deployed configuration and an item 1950*b* being inserted into an inner sleeve compartment 1914. FIG. 19E illustrates a partial cut away view of the inner sleeve 1904 showing the storage item panels 1952 in the deployed configuration and an item 1950*b* inserted into the inner sleeve compartment 1914. The inner sleeve 1904 includes a top panel of the inner sleeve 1930, a bottom panel 1932 of the inner sleeve 1904, a locking tab on the inner sleeve 1916 connected to an end of the inner sleeve 1904, and a pull tab 1906 connected to an end of the inner sleeve 1904. The inner sleeve 1904 also has the inner sleeve compartment 1914 shown in the top panel of the inner sleeve 1930 The inner sleeve compartment 1914 includes storage item panels 1952 that are configurable to hold the item 1950. Specifically, in the illustrated implementation, the inner sleeve 1904 includes two storage item panels 1952 including a first storage item panel 1954 and a second storage item panel 1956, and the first storage item panel 1954 defines the first aperture 1974 and the second storage item panel 1956 defines the second aperture 1976. The first storage item panel 1954 is separated into a first storage item end panel 1954*a* and first storage item middle panel 1954*b*.

Compared to the first aperture 1874, the first aperture 1974 is elongated such that the first aperture 1974 extends to a first end perforation 1970*a* and the first aperture 1974 includes an enlargement panel 1994. The enlargement panel 1994 rotates about the first aperture 1974 to enable the inner sleeve compartment 1914 to receive and secure larger items 1950. Additionally, the second aperture 1976 is elongated such that the second aperture 1976 extends beyond a second end perforation 1970*b*. The second storage item panel 1956 is pressed and rotated into a vertical orientation relative to the bottom panel 1932 of the inner sleeve 1904. As shown in FIG. 19C, the extension of the second aperture 1976 beyond the second end perforation 1970*b* and the vertical orientation of the second storage item panel 1956 relative to the bottom panel 1932 of the inner sleeve 1904 form a securing portion 1996 of the second aperture 1976 and an extraction portion 1998 of the second aperture 1976.

As illustrated in FIG. 19C, item 1950*a* is longer than item 1950*b*, and the inner sleeve 1904 is adjusted to receive and secure both items 1950. Items 1950 each have a cylindrical shape and have a first end 1978*a* and 1978*b* and a second end 1982*a* and 1982*b*. For example, as illustrated in FIG. 19D, the shorter item 1950*b* is received into the inner sleeve compartment 1914 by inserting the second end 1982*b* into the second aperture 1976 and inserting the first end 1978*b* into the first aperture 1974. Specifically, the first end 1978*b* is inserted into the first aperture 1974 such that the first end 1978*b* contacts but does not move the enlargement panel 1994. The enlargement panel 1994, the first aperture 1974, and the second aperture 1976 secure the item 1950*b* within the inner sleeve compartment 1914. The item 1950*b* is removed from the inner sleeve compartment 1914 of the inner sleeve 1904 by lifting the first end 1978*b* of the item 1950*b* out of the first aperture 1974 and extracting the second end 1982*b* of the item 1950*b* from the second aperture 1976 after the first end 1978*b* of the item 1950*b* has been extracted from the first aperture 1974.

As illustrated in FIG. 19E, the longer item 1950*a* is received into the inner sleeve compartment 1914 by inserting the first end 1978*a* into the first aperture 1974. Specifically, the first end 1978*a* is inserted into the first aperture 1974 such that the first end 1978*a* contacts and rotates the enlargement panel 1994 toward the bottom panel 1932 of the inner sleeve 1904 about the first end perforation 1970*a*. The second end 1982*a* is then inserted into the second aperture 1976 at least partially through the extraction portion 1998 of the second aperture 1976. The enlargement panel rotates to accommodate the longer item 1950*a* and the extraction portion 1998 of the second aperture 1976 enables the second end 1982*a* to be rotated into the securing portion 1996 of the second aperture 1976. The enlargement panel 1994, the first aperture 1974, and the second aperture 1976 secure the item 1950*a* within the inner sleeve compartment 1914, and the enlargement panel 1994 and the extraction portion 1998 of the second aperture 1976 enable the inner sleeve compartment 1914 to receive and secure the longer item 1950*a*. The longer item 1950*a* is removed from the inner sleeve compartment 1914 of the inner sleeve 1904 by lifting the second end 1982*a* of the item 1950*a* out of the extraction portion 1998 of the second aperture 1976 and extracting the first end 1978*a* of the item 1950*a* from the first aperture 1974 after the second end 1982*a* of the item 1950*a* has been extracted from the second aperture 1976.

Figure 20:
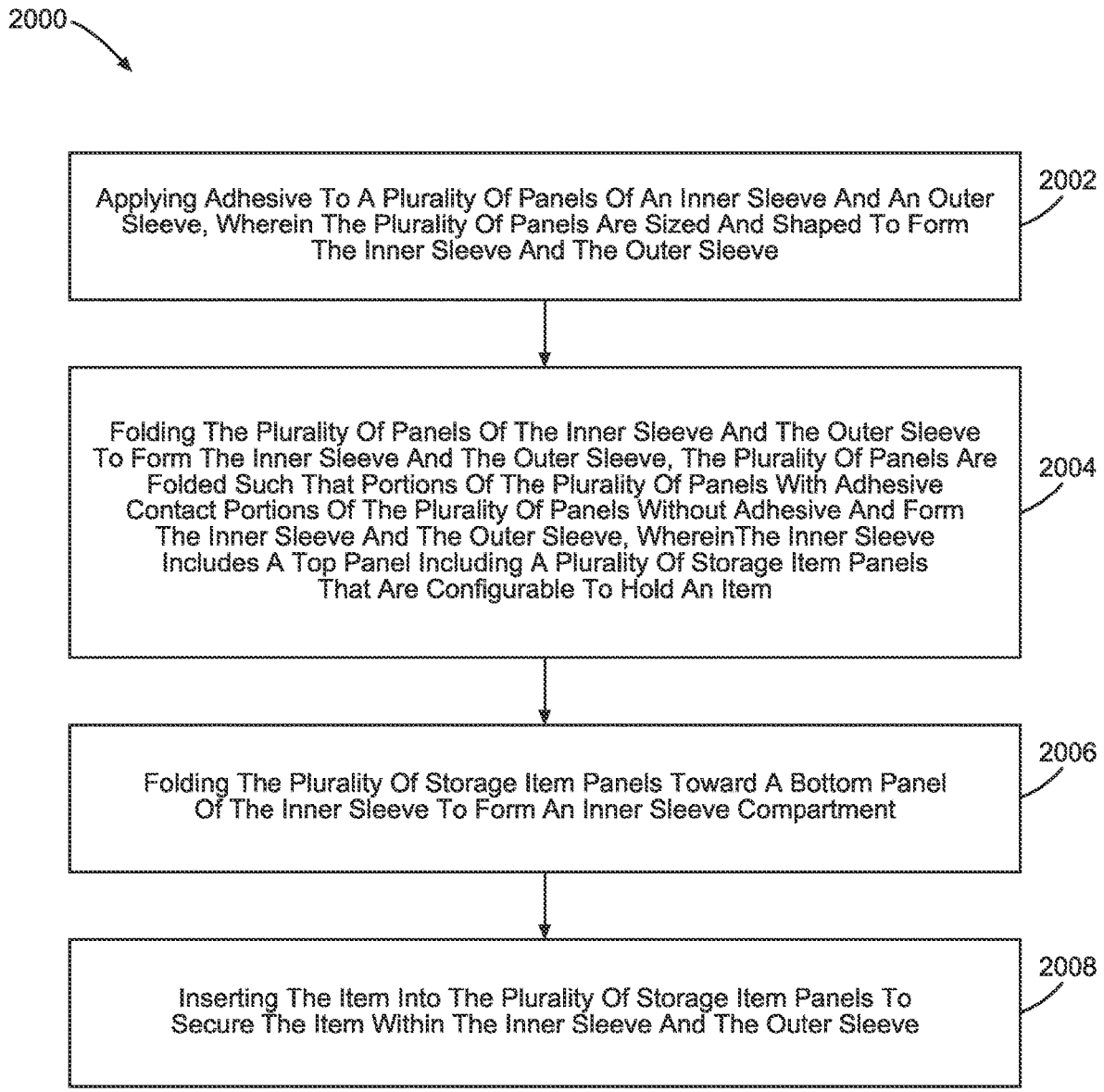
FIG. 20 is a flowchart of example operations of using a packaging apparatus.

FIG. 20 is a flowchart of example operations 2000 during assembly and use of the packaging apparatus. An operation 2002 applies adhesive to a plurality of panels of an inner sleeve and an outer sleeve. The panels are sized and shaped to form the inner sleeve and the outer sleeve.

An operation 2004 folds the panels of the inner sleeve and the outer sleeve to form the inner sleeve and the outer sleeve. The panels are folded such that the portions of the panels with adhesive contact portions of other panels without adhesive and form the inner sleeve and the outer sleeve. The inner sleeve includes a top panel including a plurality of storage item panels that are configurable to hold an item.

An operation 2006 folds the plurality of storage item panels toward a bottom panel of the inner sleeve to form an inner sleeve compartment.

An operation 2008 inserts the item into the plurality of storage item panels to secure the item within the inner sleeve and the outer sleeve.

The above specification, examples, and data provide a complete description of the structure and use of exemplary embodiments of the disclosed technology. Since many embodiments of the disclosed technology can be made without departing from the spirit and scope of the disclosed technology, the disclosed technology resides in the claims hereinafter appended. Furthermore, structural features of the different embodiments may be combined in yet another embodiment without departing from the recited claims.

What is claimed is:

1. A method of manufacturing a packaging apparatus including an outer sleeve and an inner sleeve, the method comprising:

assembling the outer sleeve, the outer sleeve comprises a first glue lap of the outer sleeve, two side panels of the outer sleeve, a top panel of the outer sleeve, and a bottom panel of the outer sleeve, wherein the first glue lap of the outer sleeve is directly attached on a first side of the first glue lap to one of the two side panels of the outer sleeve in an unassembled configuration, wherein assembling the outer sleeve comprises:

applying glue on the first glue lap of the outer sleeve; and folding the first glue lap of the outer sleeve onto the bottom panel of the outer sleeve such that the glue adheres the first glue lap of the outer sleeve to the bottom panel of the outer sleeve, wherein the first glue lap of the outer sleeve and the bottom panel of the outer sleeve form a locking ridge of the outer sleeve, wherein the locking ridge comprises a cut-out of the first glue lap that extends from a second side of the glue lap opposite the first side of the first glue lap; and assembling the inner sleeve, the inner sleeve comprises a locking tab of the inner sleeve configured to interface the locking ridge of the outer sleeve to secure the inner sleeve within the outer sleeve, the locking ridge of the outer sleeve and the locking tab of the inner sleeve at least partially define a locking mechanism.

2. The method of claim 1, wherein the inner sleeve includes an inner sleeve compartment configured to securely hold an item.

3. The method of claim 2, wherein the inner sleeve includes compartment panels of the inner sleeve located adjacent to exterior inner sleeve panels in a sheet of stock.

4. The method of claim 3, wherein the compartment panels of the inner sleeve are configured to define the inner sleeve compartment.

5. The method of claim 4, wherein the compartment panels of the inner sleeve comprise two compartment sidewalls of the inner sleeve, a middle panel of the inner sleeve, two compartment top panels of the inner sleeve, and a bottom panel of the inner sleeve compartment.

6. The method of claim 5, wherein the bottom panel of the inner sleeve compartment is attached to the middle panel of the inner sleeve.

7. The method of claim 6, wherein assembling the inner sleeve comprises folding the two compartment sidewalls of the inner sleeve and the two compartment top panels of the inner sleeve to form three compartments of the inner sleeve that run a length of the inner sleeve.

8. The method of claim 7, wherein one of the three compartments of the inner sleeve becomes the inner sleeve compartment and the other two compartments of the three compartments are not accessible from an outside of the inner sleeve.

9. The method of claim 7, wherein the inner sleeve does not include an end panel and the three compartments of the inner sleeve are open at an end of the inner sleeve to define an open end of the inner sleeve.

10. The method of claim 9, wherein the open end of the inner sleeve is oriented toward an inside of the outer sleeve when the inner sleeve is inserted into the outer sleeve and the open end of the inner sleeve is not accessible when the inner sleeve is inserted into the outer sleeve.

11. The method of claim 1, further comprising assembling the packaging apparatus by inserting the inner sleeve into the outer sleeve.

12. The method of claim 1, wherein the first glue lap of the outer sleeve, the two side panels of the outer sleeve, the top panel of the outer sleeve, and the bottom panel of the outer sleeve are arranged in a linear configuration in the unassembled configuration and the two side panels of the outer sleeve and the top panel of the outer sleeve are positioned between the bottom panel of the outer sleeve and the first glue lap of the outer sleeve in the unassembled, linear configuration.

13. A method of manufacturing a packaging apparatus including an outer sleeve, the method comprising:

assembling the outer sleeve, the outer sleeve comprises a first glue lap, two side panels, a top panel, and a bottom panel, wherein the first glue lap is directly attached on a first side of the first glue lap to one of the two side panels in an unassembled configuration, wherein assembling the outer sleeve comprises:

applying glue on the first glue lap; and folding the first glue lap onto the bottom panel such that the glue adheres the first glue lap to the bottom panel, wherein the first glue lap and the bottom panel form a locking ridge of a locking mechanism, wherein the locking ridge comprises a cut-out of the first glue lap that extends from a second side of the glue lap opposite the first side of the first glue lap.

14. The method of claim 13, wherein the first glue lap of the outer sleeve, the two side panels of the outer sleeve, the top panel of the outer sleeve, and the bottom panel of the outer sleeve are arranged in a linear configuration in the unassembled configuration and the two side panels of the outer sleeve and the top panel of the outer sleeve are positioned between the bottom panel of the outer sleeve and the first glue lap of the outer sleeve in the unassembled, linear configuration.

* * * * *